US005826651A

United States Patent [19]

Lee et al.

[11] Patent Number: 5,826,651

[45] Date of Patent: Oct. 27, 1998

[54] WELLBORE SINGLE TRIP MILLING

[75] Inventors: Mark H. Lee, Spring; Thurman B. Carter, Houston; William A. Blizzard, Jr., Houston; Richard M. Ward, Houston, all of Tex.

[73] Assignee: Weatherford/Lamb, Inc., Houston, Tex.

[21] Appl. No.: 688,651

[22] Filed: Jul. 30, 1996

Related U.S. Application Data

[63] Continuation-in-part of Ser. No. 673,791, Jun. 27, 1996, abandoned, which is a continuation-in-part of Ser. No. 210,697, Mar. 18, 1994, Pat. No. 5,429,187, and a division of Ser. No. 414,201, Mar. 31, 1995, Pat. No. 5,531,271, which is a continuation-in-part of Ser. No. 300,917, Sep. 6, 1994, Pat. No. 5,425,417, which is a continuation-in-part of Ser. No. 225,384, Apr. 4, 1994, Pat. No. 5,409,060, which is a continuation-in-part of Ser. No. 119,813, Sep. 10, 1993, Pat. No. 5,452,759.

[51] Int. Cl.[6] ..... E21B 7/08; E21B 29/06

[52] U.S. Cl. ..... 166/117.6; 175/80; 175/82

[58] Field of Search ..... 166/117.6; 175/79–82

[56] References Cited

U.S. PATENT DOCUMENTS

| | | | |
|---|---|---|---|
| 1,570,518 | 1/1926 | Mitchell | 166/117.6 |
| 1,589,399 | 6/1926 | Kinzbach . | |
| 1,636,032 | 7/1927 | Abbott | 166/117.6 |
| 1,804,819 | 5/1931 | Spencer, Jr. et al. | 166/117.6 |
| 1,812,880 | 7/1931 | Kinzbach et al. | 166/117.6 |
| 1,816,856 | 8/1931 | Kinzbach et al. . | |
| 1,835,227 | 12/1931 | Lane et al. . | |
| 1,866,087 | 7/1932 | Crowell . | |
| 1,869,759 | 8/1932 | Lynch . | |
| 1,951,638 | 3/1934 | Walker . | |
| 2,014,805 | 9/1935 | Hinderliter . | |
| 2,043,381 | 6/1936 | Lane . | |
| 2,065,896 | 12/1936 | Keever . | |
| 2,101,185 | 12/1937 | Monroe . | |

(List continued on next page.)

FOREIGN PATENT DOCUMENTS

| | | |
|---|---|---|
| 727897 | 4/1955 | United Kingdom . |
| 2299106 | 9/1996 | United Kingdom . |
| WO 93/15301 | 8/1993 | WIPO . |
| WO 94/06996 | 3/1994 | WIPO . |

OTHER PUBLICATIONS

"Kinzbach Tool Co., Inc. Catalog 1958 — 59," Kinzbach Tool Company, Inc., 1958; see pp. 3 –5 paraticularly.

"Dual horizontal extension drilled using retrievable whipstock," Cress et al, Worked Oil, Jun. 1993, five pages.

"Casing Whipstocks," Eastman Whipstock, Composite Catalog, p. 2226, 1976 –77.

"Bowen Whipstocks," Bowen Oil Tools, Composite Catalog, one page, 1962 –1963.

(List continued on next page.)

*Primary Examiner*—Hoang C. Dang
*Attorney, Agent, or Firm*—Guy McClung

[57] ABSTRACT

Wellbore operations (e.g. for milling and/or drilling) are disclosed which require a reduced number of tool trips into a wellbore to create a cut-out pocket or window in a tubular such as casing in the wellbore and, in some aspects, to continue into a formation adjacent a main wellbore forming a lateral wellbore in communication with the main wellbore. Preferably one trip is required. A milling apparatus has been invented with milling apparatus for milling a tubular member and a nose cone releasably connected to the milling apparatus and releasably connectible to a diverter that directs the milling apparatus toward the tubular member. A nose cone for a milling apparatus has been invented with a body member, the body member having a mid portion, a top portion and a lower nose portion, and the top portion releasably securable to the milling apparatus and the lower nose portion releasably securable to a concave of a whipstock. A whipstock has been invented with a body member having an upwardly extending concave portion with a concave surface, and at least a portion of the concave surface contactable by a milling apparatus during a milling procedure covered with armor material.

9 Claims, 16 Drawing Sheets

U.S. PATENT DOCUMENTS

| | | | |
|---|---|---|---|
| 2,103,622 | 12/1937 | Kinzbach . | |
| 2,105,721 | 1/1938 | Cutrer et al. . | |
| 2,105,722 | 1/1938 | Barrett et al. | 175/81 |
| 2,132,061 | 10/1938 | Walker | 166/117.6 |
| 2,170,284 | 8/1939 | Eastman | 166/117.6 |
| 2,197,344 | 4/1940 | Matlock | 166/117.6 |
| 2,207,920 | 7/1940 | Hughes | 175/81 |
| 2,227,347 | 12/1940 | Johnson | 175/82 X |
| 2,298,706 | 10/1942 | Kothny . | |
| 2,312,656 | 3/1943 | LeBus . | |
| 2,324,682 | 7/1943 | DeLong . | |
| 2,331,293 | 10/1943 | Ballard . | |
| 2,338,788 | 1/1944 | Walker | 166/117.6 |
| 2,362,529 | 11/1944 | Barrett et al. . | |
| 2,445,100 | 7/1948 | Wright . | |
| 2,495,439 | 1/1950 | Brinble . | |
| 2,509,144 | 5/1950 | Grable et al. . | |
| 2,567,507 | 9/1951 | Brown . | |
| 2,586,878 | 2/1952 | Staton . | |
| 2,633,331 | 3/1953 | Hampton . | |
| 2,664,162 | 12/1953 | Howard et al. | 116/117.5 |
| 2,694,549 | 11/1954 | James . | |
| 2,699,920 | 1/1955 | Zublin | 166/117.6 |
| 2,770,444 | 11/1956 | Neal | 166/117.6 |
| 2,775,306 | 12/1956 | Middleton et al. | 166/125 X |
| 2,797,893 | 7/1957 | McCune et al. | 175/79 |
| 2,807,440 | 9/1957 | Beck | 166/117.6 |
| 2,882,015 | 4/1959 | Beck . | |
| 2,950,900 | 8/1960 | Wynes | 175/61 |
| 2,976,931 | 3/1961 | Daffin | 166/125 |
| 3,000,440 | 9/1961 | Malcomb | 166/4 |
| 3,075,583 | 1/1963 | Nielsen | 166/117.5 |
| 3,095,039 | 6/1963 | Kinzbach | 166/117.6 |
| 3,096,824 | 7/1963 | Brown | 166/210 |
| 3,116,799 | 1/1964 | Lemons | 175/61 |
| 3,172,488 | 3/1965 | Roxstrom | 175/81 |
| 3,194,594 | 7/1965 | Hagler | 166/125 X |
| 3,248,129 | 4/1966 | Brown | 166/240 X |
| 3,602,306 | 8/1971 | Alexander | 166/217 |
| 3,667,252 | 6/1972 | Nelson | 64/23.5 |
| 3,669,187 | 6/1972 | Alexander, Jr. | 166/217 |
| 3,908,759 | 9/1975 | Cagle et al. | 166/117.6 |
| 4,007,797 | 2/1977 | Jeter | 175/26 |
| 4,101,157 | 7/1978 | Richey | 166/240 X |
| 4,135,577 | 1/1979 | Nelson et al. | 166/241.1 |
| 4,153,109 | 5/1979 | Szescila | 166/250 |
| 4,266,621 | 5/1981 | Brock | 175/329 |
| 4,273,464 | 6/1981 | Scott | 166/240 X |
| 4,285,399 | 8/1981 | Holland et al. | 166/113 |
| 4,304,299 | 12/1981 | Holland et al. | 166/255 |
| 4,307,780 | 12/1981 | Curington | 166/113 |
| 4,397,355 | 8/1983 | McLamore | 166/297 |
| 4,397,360 | 8/1983 | Schmidt | 175/61 |
| 4,429,741 | 2/1984 | Hyland | 166/63 |
| 4,450,912 | 5/1984 | Callihan et al. | 166/289 |
| 4,491,178 | 1/1985 | Terrell et al. | 166/192 |
| 4,550,781 | 11/1985 | Kagler et al. | 166/340 |
| 4,610,309 | 9/1986 | O'Brien et al. | 166/382 X |
| 4,637,471 | 1/1987 | Soderberg | 166/373 |
| 4,646,826 | 3/1987 | Bailey et al. | 166/55.3 |
| 4,665,995 | 5/1987 | Braithwaite et al. | 175/45 |
| 4,733,732 | 3/1988 | Lynch | 175/9 |
| 4,765,404 | 8/1988 | Bailey et al. | 166/117.6 |
| 4,796,709 | 1/1989 | Lynde et al. | 166/55.6 |
| 4,807,704 | 2/1989 | Hsu et al. | 166/313 |
| 4,844,167 | 7/1989 | Clark | 175/4.53 |
| 4,887,668 | 12/1989 | Lynde et al. | 166/55.8 |
| 4,938,291 | 7/1990 | Lynde et al. | 116/55.8 |
| 4,978,260 | 12/1990 | Lynde et al. | 166/55.6 |
| 4,984,488 | 1/1991 | Lunde et al. | 76/115 |
| 5,014,778 | 5/1991 | Lynde et al. | 166/55.6 |
| 5,035,292 | 7/1991 | Bailey et al. | 175/45 |
| 5,038,859 | 8/1991 | Lynde et al. | 166/55.6 |
| 5,058,666 | 10/1991 | Lynde et al. | 166/55.6 |
| 5,086,838 | 2/1992 | Cassel et al. | 166/55.6 |
| 5,109,924 | 5/1992 | Jurgens et al. | 166/117.5 |
| 5,113,938 | 5/1992 | Clayton | 166/117.6 |
| 5,115,872 | 5/1992 | Brunet et al. | 175/61 |
| 5,150,755 | 9/1992 | Cassel et al. | 166/297 |
| 5,154,231 | 10/1992 | Bailey et al. | 166/298 |
| 5,163,522 | 11/1992 | Eaton et al. | 175/58 |
| 5,186,254 | 2/1993 | Van Staden | 166/105 |
| 5,193,620 | 3/1993 | Braddick | 166/382 |
| 5,195,591 | 3/1993 | Blount et al. | 166/380 |
| 5,199,513 | 4/1993 | Stewart et al. | 175/73 |
| 5,211,715 | 5/1993 | Braden et al. | 175/58 |
| 5,222,554 | 6/1993 | Blount et al. | 166/117.6 |
| 5,253,710 | 10/1993 | Carter et al. | 166/298 |
| 5,265,675 | 11/1993 | Hearn et al. | 166/297 |
| 5,277,251 | 1/1994 | Blount et al. | 166/117.5 |
| 5,287,921 | 2/1994 | Blount et al. | 166/117.6 |
| 5,287,922 | 2/1994 | Bridges | 166/277 |
| 5,297,630 | 3/1994 | Lynde et al. | 166/297 |
| 5,318,121 | 6/1994 | Brockman | 166/313 |
| 5,318,122 | 6/1994 | Murray et al. | 166/313 |
| 5,322,127 | 6/1994 | McNair et al. | 166/313 |
| 5,335,737 | 8/1994 | Baugh | 175/61 |
| 5,341,873 | 8/1994 | Carter et al. | 166/117.5 |
| 5,346,017 | 9/1994 | Blount et al. | 166/380 |
| 5,373,900 | 12/1994 | Lynde et al. | 166/297 |
| 5,379,845 | 1/1995 | Blount et al. | 166/117.6 |
| 5,425,419 | 6/1995 | Sieber | 166/206 |
| 5,431,220 | 7/1995 | Lennon et al. | 166/55.7 |
| 5,431,223 | 7/1995 | Konopczynski | 166/117.5 |
| 5,443,129 | 8/1995 | Bailey et al. | 175/45 |
| 5,445,222 | 8/1995 | Pritchard et al. | 116/298 |
| 5,456,312 | 10/1995 | Lynde et al. | 166/55.6 |
| 5,458,209 | 10/1995 | Hayes et al. | 175/61 |
| 5,462,120 | 10/1995 | Gondouin | 166/380 |
| 5,467,819 | 11/1995 | Braddick | 166/117.6 |
| 5,474,126 | 12/1995 | Lynde et al. | 166/117.6 |
| 5,499,680 | 3/1996 | Walter et al. | 166/377 |
| 5,564,503 | 10/1996 | Longbottom et al. | 166/313 |
| 5,566,763 | 10/1996 | Williamson et al. | 166/382 |
| 5,595,247 | 1/1997 | Braddick | 166/297 |
| 5,620,051 | 4/1997 | Carter et al. | 166/298 |

OTHER PUBLICATIONS

"Improved Casing Sidetrack Procedure Now Cuts Wider, Larger Windows," Cagle et al, Petroleum Engineer International, Mar. 1979.

"Weatherford Fishing and Rental tool Services," 1993.

A–1 Bit & Tool company 1990 –01 General Catalog, pp. 8, 14.

Frank's, "The Submudline Drivepipe Whipstock, Patent #4,733,732".

"Directional Drilling Tools," Homoco Associated Oil Field Rentals, Composite Catalog 1964 –1965, pp. 2391, 2392, 2394.

"A–Z Stub Type Whipstock," A–Z Int'l Tool Co., 1976 –1977 Composite Catalog, p. 219.

TIW Window Cutting Products & Services, TIW Corp., 1994.

FIG. 10a
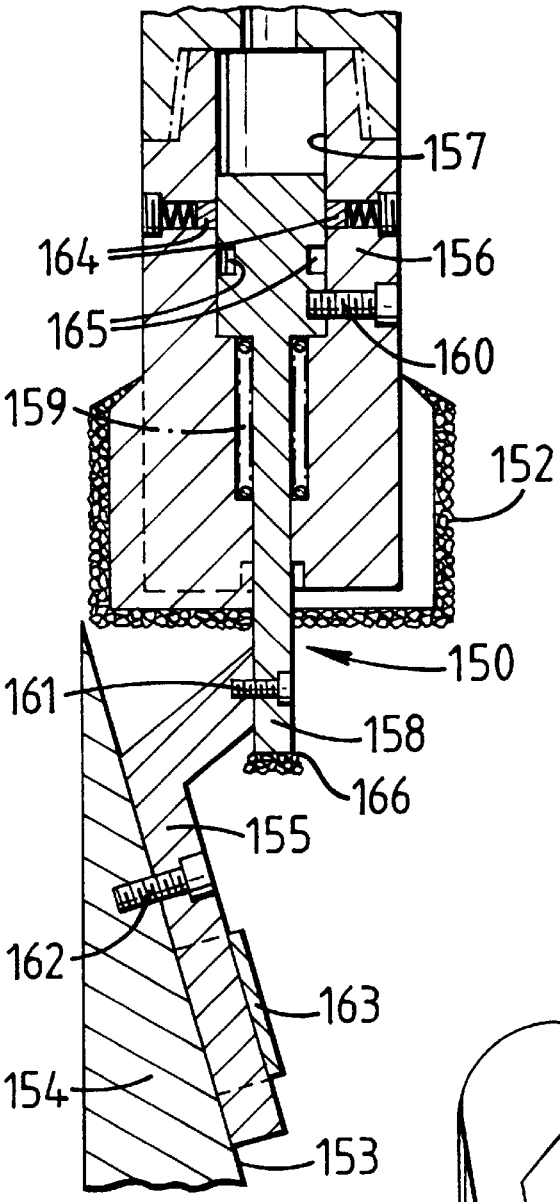
FIG. 11
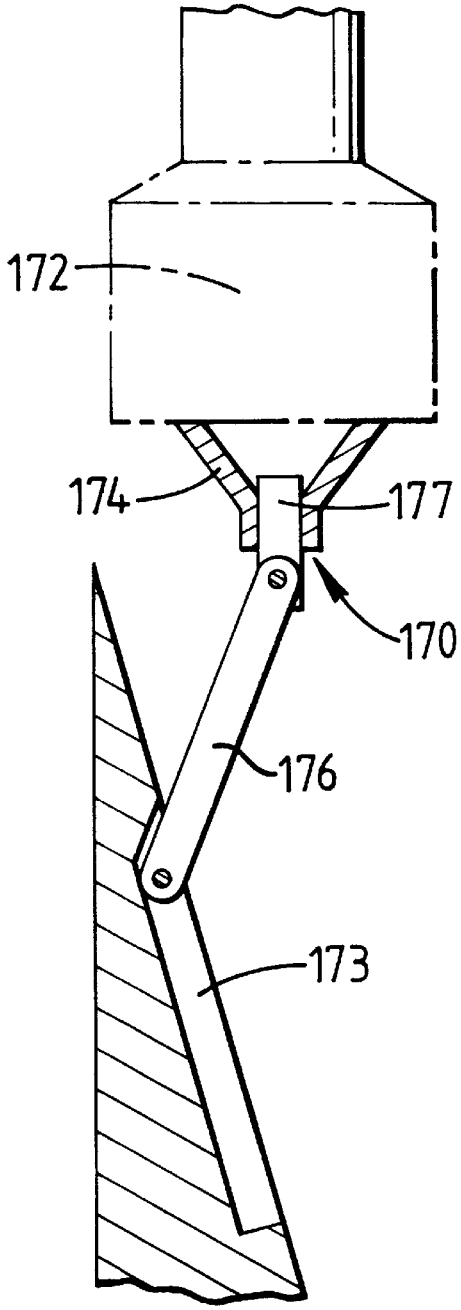
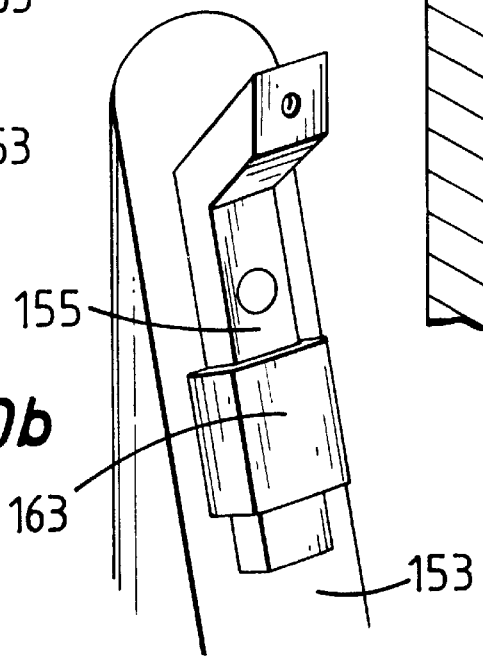
FIG. 10b

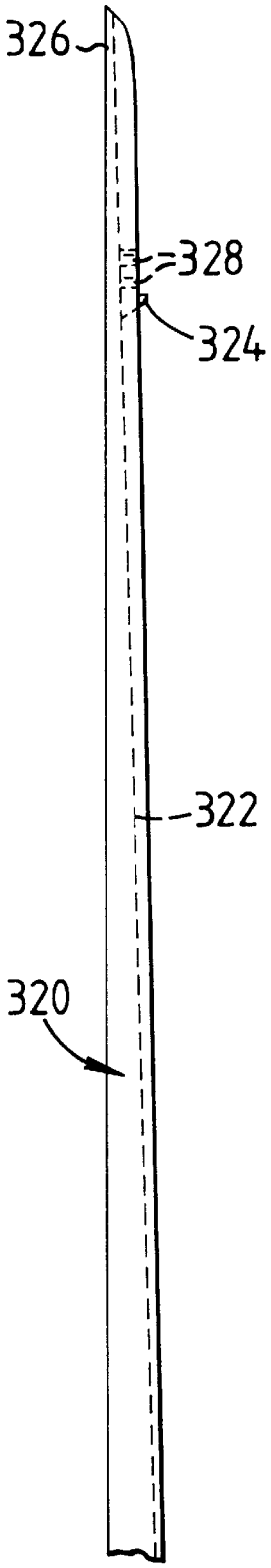
FIG. 18b
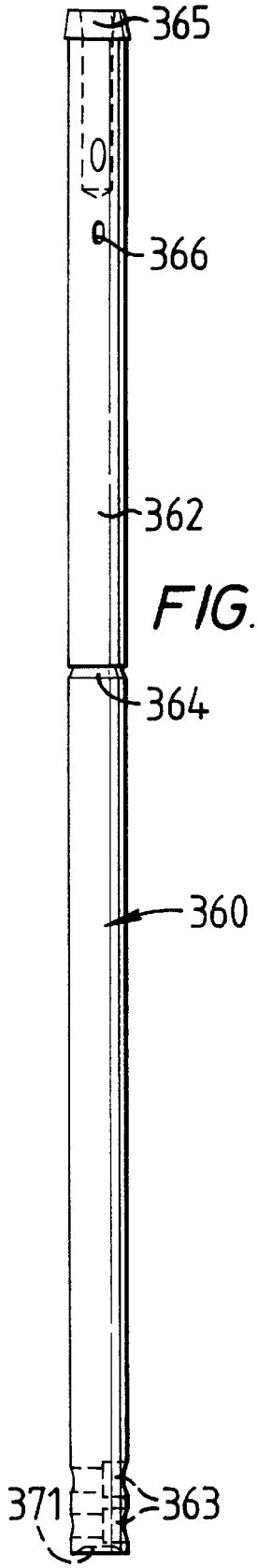
FIG. 18c
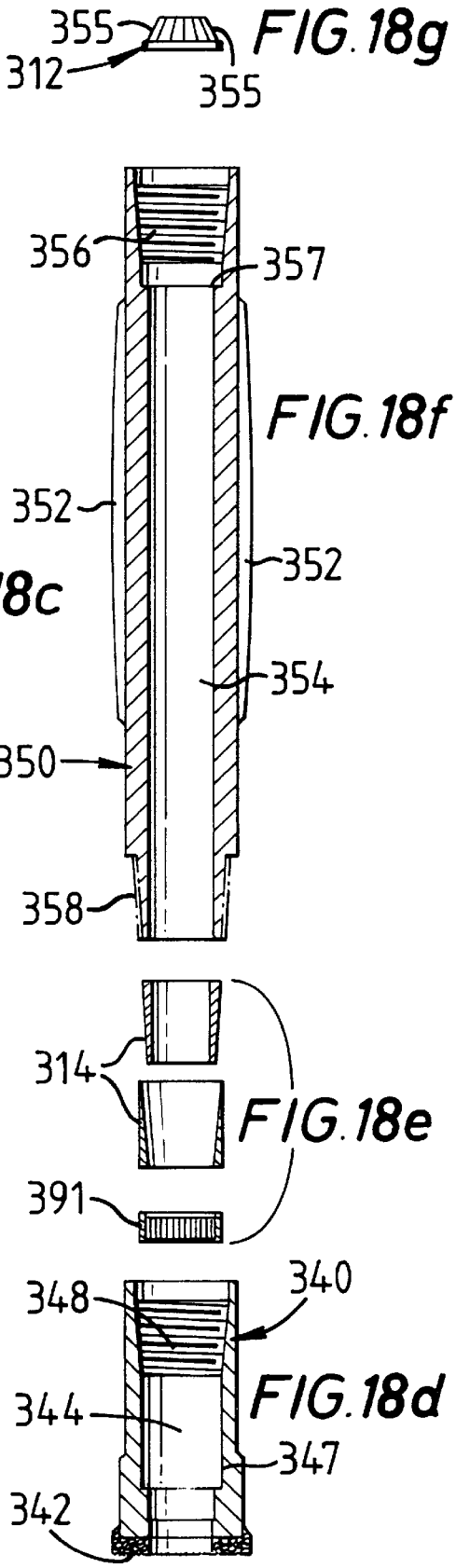
FIG. 18g
FIG. 18f
FIG. 18e
FIG. 18d FIG. 18h
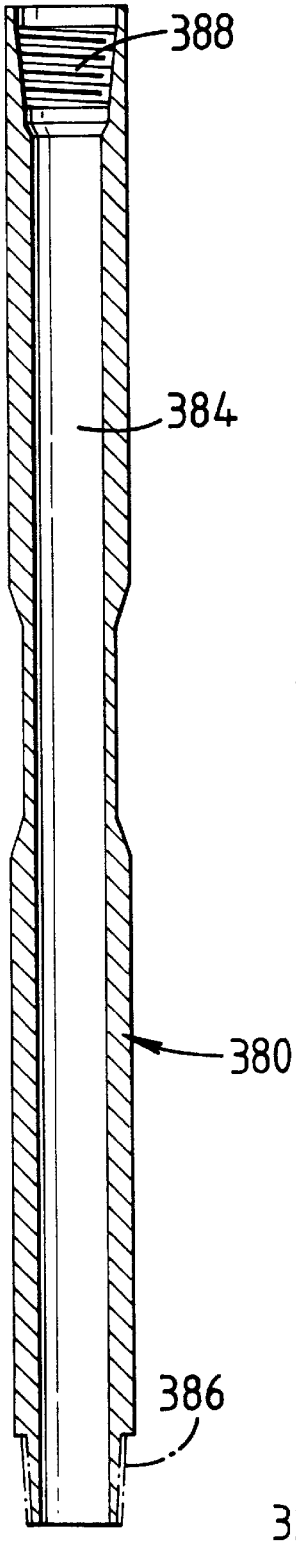
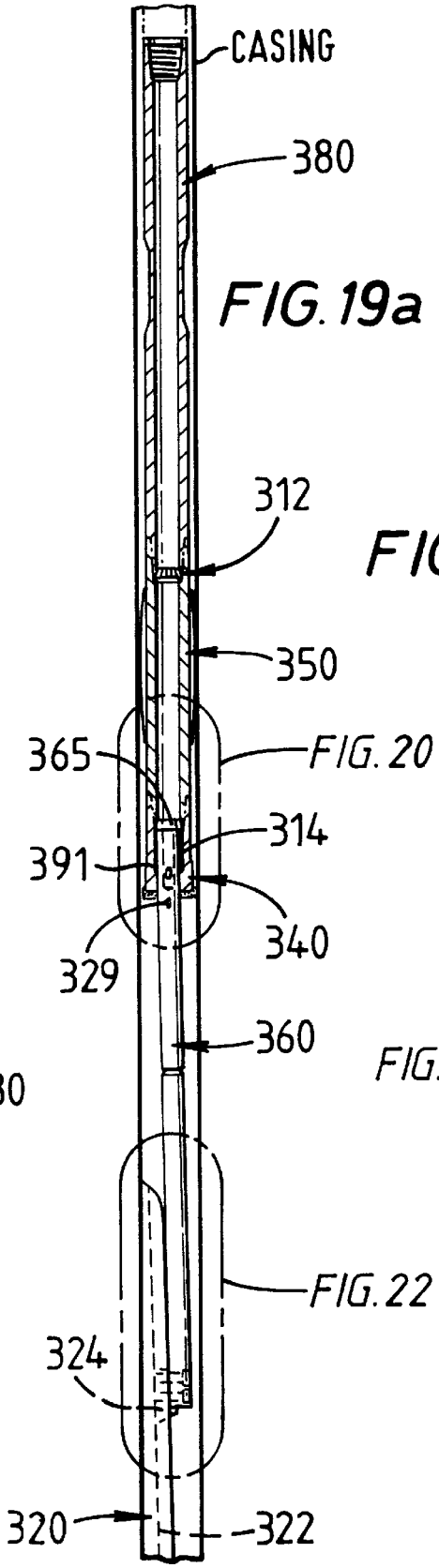
FIG. 19a
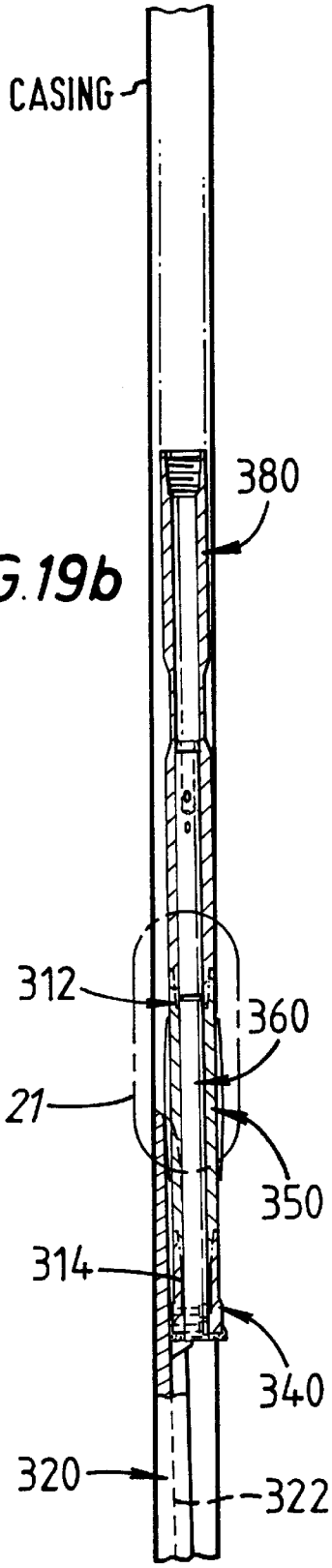
FIG. 19b FIG. 20
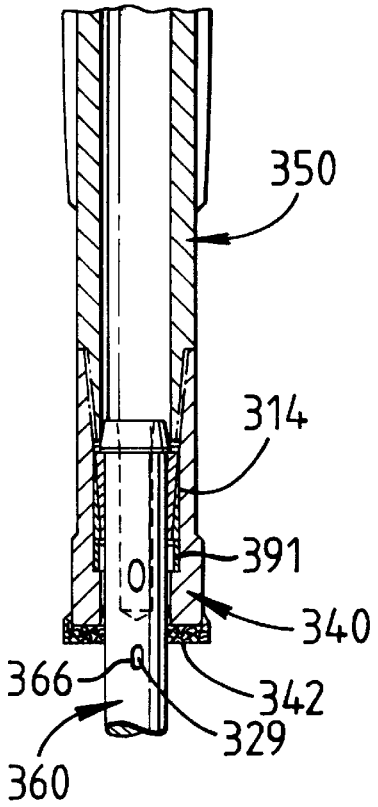
FIG. 21
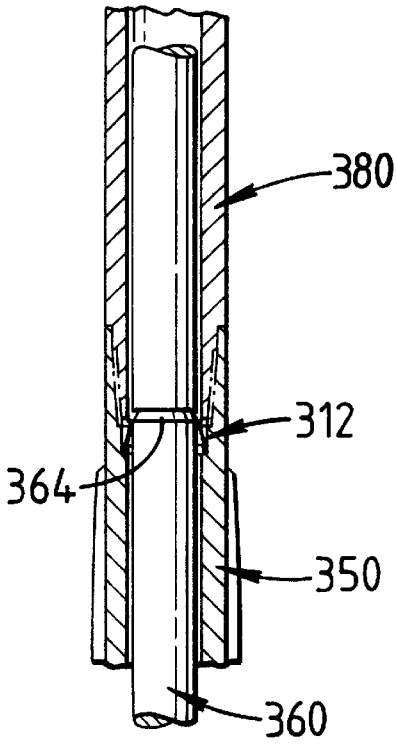
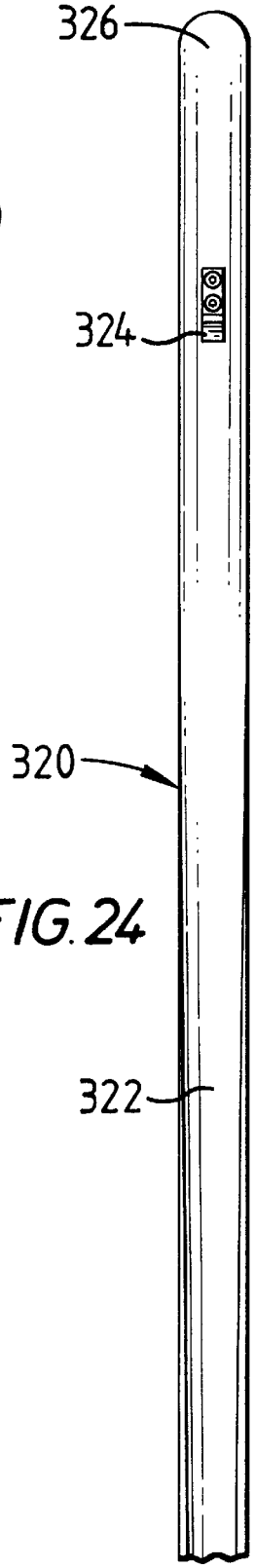
FIG. 22
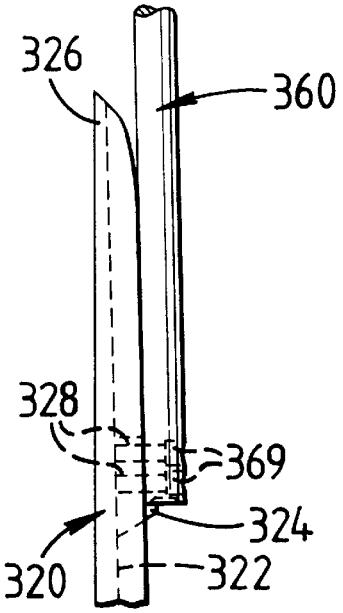
FIG. 23
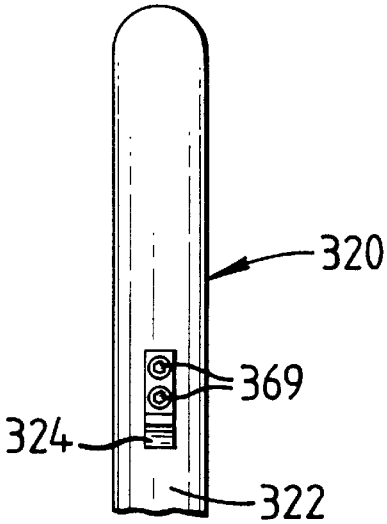
FIG. 24

WELLBORE SINGLE TRIP MILLING

RELATED APPLICATIONS

This is a continuation-in-part of pending U.S. application Ser. No. 08/673,791 filed on Jun. 27, 1996 entitled "Wellbore Securement System," now abandoned, which is a continuation-in-part of U.S. application Ser. No. 08/210,697 filed on Mar. 18, 1994 entitled "Milling Tool & Operations" now U.S. Pat. No. 5,429,187 issued Jul. 4, 1995 and is a division of application Ser. No. 414,201 filed on Mar. 31, 1995 entitled "Whipstock Side Support" now U.S. Pat. No. 5,531,271 issued Jul. 2, 1996, which is a continuation-in-part of U.S. application Ser. No. 08/300,917, filed on Sep. 6, 1994 entitled "Wellbore Tool Setting System" now U.S. Pat. No. 5,425,417 issued Jun. 20, 1995 which is a continuation-in-part of U.S. application Ser. No. 08/225,384, filed on Apr. 4, 1994 entitled "Wellbore Tool Orientation," now U.S. Pat. No. 5,409,060 issued on Apr. 25, 1995 which is a continuation-in-part of U.S. application Ser. No. 08/119,813 filed on Sep. 10, 1993 entitled "Whipstock System" now U.S. Pat. No. 5,452,759 issued on Sep. 26, 1995 and is

BACKGROUND OF THE INVENTION

1. Field of the Invention

This invention is related to milling and drilling methods, tools and whipstocks; and in one aspect to single-trip milling methods and systems.

2. Description of Related Art

Milling tools are used to cut out windows or pockets from a tubular, e.g. for directional drilling and sidetracking; and to remove materials downhole in a well bore, such as pipe, casing, casing liners, tubing, or jammed tools. Drilling systems are used to drill wellbores, both main boreholes and lateral bores extending therefrom. The prior art discloses various types of drilling, milling and cutting tools provided for drilling a formation or for cutting or milling existing pipe or casing previously installed in a well. Certain of these tools have cutting blades or surfaces and are lowered into the well or casing and then rotated in a drilling or cutting operation. With certain tools, a suitable drilling fluid is pumped down a central bore of a tool for discharge beneath the cutting blades. An upward flow of the discharged fluid in the annulus outside the tool removes from the well cuttings or chips resulting from the cutting operation. Milling of casing can result in the formation of part of a lateral borehole when a mill exits the casing and bores into the formation.

Milling tools have been used for removing a section or "window" of existing casing from a well bore to permit a sidetracking operation in directional drilling, to provide a perforated production zone at a desired level, to provide cement bonding between a small diameter casing and the adjacent formation, or to remove a loose joint of surface pipe. Also, milling tools are used for milling or reaming collapsed casing, for removing. burrs or other imperfections from windows in the casing system, for placing whipstocks in directional drilling, or for aiding in correcting dented or mashed-in areas of casing or the like.

Prior art sidetracking methods use cutting tools of the type having cutting blades and use a diverter or a deflector such as a whipstock to cause the tool to be moved laterally while it is being moved downwardly in the well during rotation of the tool to cut an elongated opening, pocket, or window in the well casing.

Certain prior art well sidetracking operations which employ a whipstock also employ a variety of different milling tools used in a certain sequence. This sequence of operation requires a plurality of "trips" into the wellbore. For example, in certain multi-trip operations, a packer is set in a wellbore at a desired location. This packer acts as an anchor against which tools above it may be urged to activate different tool functions. The packer typically has a key or other orientation indicating member. The packer's orientation is checked by running a tool such as a gyroscope indicator into the wellbore. A whipstock-mill combination tool is then run into the wellbore by first properly orienting a stinger at the bottom of the tool with respect to a concave face of the tool's whipstock. Splined connections between a stinger and the tool body facilitate correct stinger orientation. A starting mill is secured at the top of the whipstock, e.g. with a setting stud and nut. The tool is then lowered into the wellbore so that the packer engages the stinger and the tool is oriented. Slips extend from the stinger and engage the side of the wellbore to prevent movement of the tool in the wellbore. Pulling on the tool then shears the setting stud, freeing the starting mill from the tool. Rotation of the string with the starting mill rotates the mill. The starting mill has a tapered portion which is slowly lowered to contact a pilot lug on the concave face of the whipstock. This forces the starting mill into the casing to mill off the pilot lug and cut an initial window in the casing. The starting mill is then removed from the wellbore. A window mill, e.g. on a flexible joint of drill pipe, is lowered into the wellbore and rotated to mill down from the initial window formed by the starting mill. Typically then a window mill with a watermelon mill mills all the way down the concave face of the whipstock forming a desired cut-out window in the casing. This may take multiple trips. Then, the used window mill is removed and a new window mill and string mill and a watermelon mill are run into the wellbore with a drill collar (for rigidity) on top of the watermelon mill to lengthen and straighten out the window and smooth out the window-casing-open-hole transition area. The tool is then removed from the wellbore.

There has long been a need for an efficient and effective milling method in which the number of trips into the wellbore is reduced. There has long been a need for tools useful in such methods, particularly in single-trip milling methods.

SUMMARY OF THE PRESENT INVENTION

The present invention, in one embodiment, discloses a mill with a nose member or a nose cone releasably attached to a mill, the nose cone extending downwardly from the mill and having a lower end or nose releasably connected to a diverter or whipstock set in the casing. The nose cone may be solid; it may be a hollow cone; it may have one connecting bar attached to the center or side of the mill; or it may have two, three, or more spaced-apart fins, ribs or struts that connect it to the mill. The nose cone can be made of metal (e.g. brass, aluminum, zinc, steel, or an alloy or combination thereof of any of these), plastic, fiberglass, cermet, composite, wood, or any other suitable material.

In one aspect the nose cone is hollow and tapered with three upper fingers for receipt in corresponding holding slots in a mill body. The fingers may be held in the slots with shear pins or with explosive bolts or an explosive charge may be used to separate the fingers and therefore the nose cone from a mill. Alternatively, the fingers themselves may be shear members which shear when a desired force is applied to them. The nose cone's length is sufficient to space cutting elements on the mill above the top of a concave of a whipstock prior to release of the nose cone from the whipstock. A shear bolt in a lug extending out from the whipstock may be used to releasably secure the nose cone to the whipstock. The nose cone is also sufficiently long so that upon release from the lug the nose cone moves down past the lug while contacting the lug, thus directing the mill above the nose cone against a casing in which the system is disposed in a wellbore. Rotating the mill (either by a downhole motor on coiled tubing or by a rotary at the surface) initiates the creation of an opening or window in the casing at a level even with or above the top of the concave. This milling of the casing continues until the mill encounters the lug and mills it off while still milling the window opposite the concave. After the lug is milled off the mill is in contact with the concave and the concave directs the mill outwardly against the casing for further milling of the window. In one preferred embodiment, at the point at which the lug is milled off, the casing has been completely milled through for at least a minimal axial distance thus facilitating further milling of the casing (rather than milling of the concave) and producing minimal damage to and milling of the concave.

As the mill mills the lug the nose cone's fingers are released. In another aspect, the nose cone is positioned so that it can be subject to the pressure of fluid flowing down through a mill to which the nose cone is attached and the pressure of the fluid shears shear pins or bolts holding the nose cone to the mill. The nose cone upon release falls down beneath the mill between the concave and the casing. At some point, in one aspect, the mill encounters the nose cone and mills past and/or through it. In another aspect, the nose cone is detonated with known explosives, preferably without adverse consequences to the formation. To inhibit or prevent nose cone rotation after its release, it may have a spike or point on its lower surface and/or an outer helical thread or helical surface which engages the casing and/or the concave.

In one aspect the nose cone is made of steel; in one aspect it is mild steel.

The present invention also discloses a variety of other devices, apparatuses, and mechanisms for initial guidance of a mill, for spacing it apart from and (in some aspects) above a concave during initial milling of casing, and for facilitating window initiation prior to mill-concave contact. Once a substantial amount of casing thickness has been milled prior to mill-concave contact or, more preferably, the entire casing thickness has been milled through, the concave's job of forcing the mill against the casing for the completion of a milled window is made easier and damage to the concave is reduced.

In another aspect a minor portion at the top, a major portion, substantially all, or all of the concave is hardfaced e.g. with tungsten carbide, or armored with suitable armor material, e.g. Conforma Clad™ material, Arnco 200™ hard banding material, or Technoginia™ material. Such material is welded on, baked on, plasma flame-sprayed on or explosively bonded to the concave. The hardfacing or armor is preferably harder than the casing to be milled so that a mill will preferentially mill the casing.

It is, therefore, an object of at least certain preferred embodiments of the present invention to provide:

New, useful, unique, efficient, non-obvious milling systems, milling tools, whipstocks, and devices and methods for milling operations;

A milling system and method requiring a single trip into a wellbore to create a desired opening or window in a tubular in the wellbore;

A milling method in which a window is milled at a desired location in a casing;

A nose cone, pilot cone, or other mechanism for initially releasably spacing a mill apart from a top portion of a concave of a whipstock set in tubing, casing, or a wellbore while at least initial milling is accomplished; and New, useful, unique, efficient non-obvious systems for producing at least part of a lateral wellbore extending from a main wellbore.

This invention resides not in any particular individual feature disclosed herein, but in combinations of them and it is distinguished from the prior art in these combinations with their structures and functions. There has thus been outlined, rather broadly, features of the invention in order that the detailed descriptions thereof that follow may be better understood, and in order that the present contributions to the arts may be better appreciated. There are, of course, additional features of the invention that will be described hereinafter and which may be included in the subject matter of the claims appended hereto. Those skilled in the art who have the benefit of this invention will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar as they do not depart from the spirit and scope of the present invention.

The present invention recognizes and addresses the previouslymentioned problems and needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention as broadly as legally possible no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

FIG. 10*a* is a side view in cross-section of a milling system according to the present invention. FIG. 10*b* is a partial view of the system of FIG. 10*a*.

FIGS. 11–14 are side views in cross-section of milling systems according to the present invention.

FIG. 18*a*–18*h* are side views of parts of a milling system according to the present invention. FIGS. 18*d*–18*h* are in cross-section.

FIGS. 19*a* and 19*b* show the milling system including the parts shown in FIGS. 18*a*–18*h* and show steps in the operation of the system.

FIG. 20 is an enlarged view of part of the tool show in FIG. 19*a*.

FIG. 21 is an enlarged view of a part of the tool shown in FIG. 19*b*.

FIG. 22 is an enlarged view of a portion of the tool of FIG. 19*a*.

FIG. 23 is a side view of the tool as shown in FIG. 22.

FIG. 24 is a side view of the whipstock concave member of the tool of FIG. 19*a*.

DESCRIPTION OF EMBODIMENTS PREFERRED AT THE TIME OF FILING FOR THIS PATENT

Figure 1:
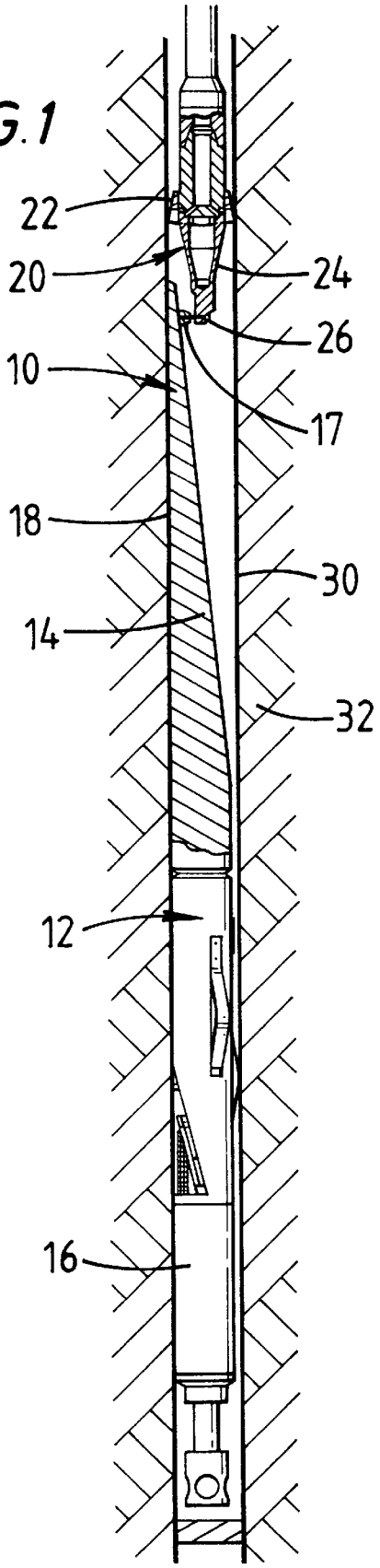
FIG. 1 is a side view in cross-section of a milling system according to the present invention.

FIG. 1 shows a system 10 according to the present invention which has a milling system 20 according to the present invention, and a whipstock 12 with a concave 14 and an anchor or setting tool 16. The milling system 20, connected to a tubular string or coiled tubing 34 and rotatable by a downhole motor 36 or by a rotary (not shown) has a mill 22 and a nose cone 24 releasably attached at the top to the mill 22 and at the bottom with a shear bolt 26 to a lug 17 of the whipstock 12. The whipstock 12 may be any known whipstock or diverter for a bit or mill. The system 10 is in a tubular string 18 (e.g. casing) in a wellbore 30 extending through a formation 32 from the earth's surface to a point underground.

Figure 2:
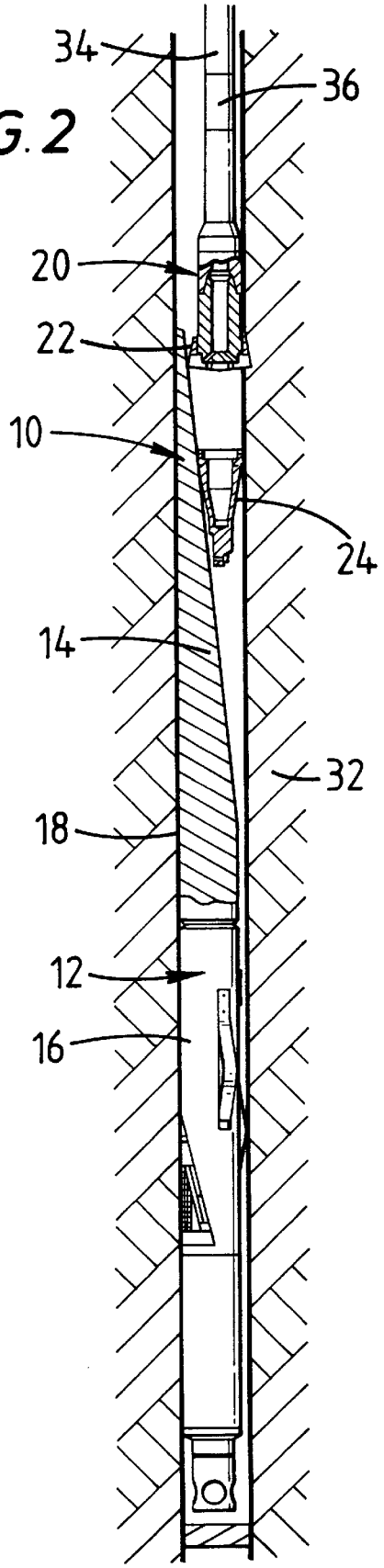
FIGS. 2 is a temporally subsequent view to that of FIG. 1.

As shown in FIG. 2, the shear bolt 26 has been sheared by increasing weight on the milling system 20, the nose cone 24 has been released and has fallen down wedging itself between the concave and the casing, and the mill 22 has milled through the lug and through the casing to initiate a casing window slightly above and adjacent the top of the concave 14.

Figure 3:
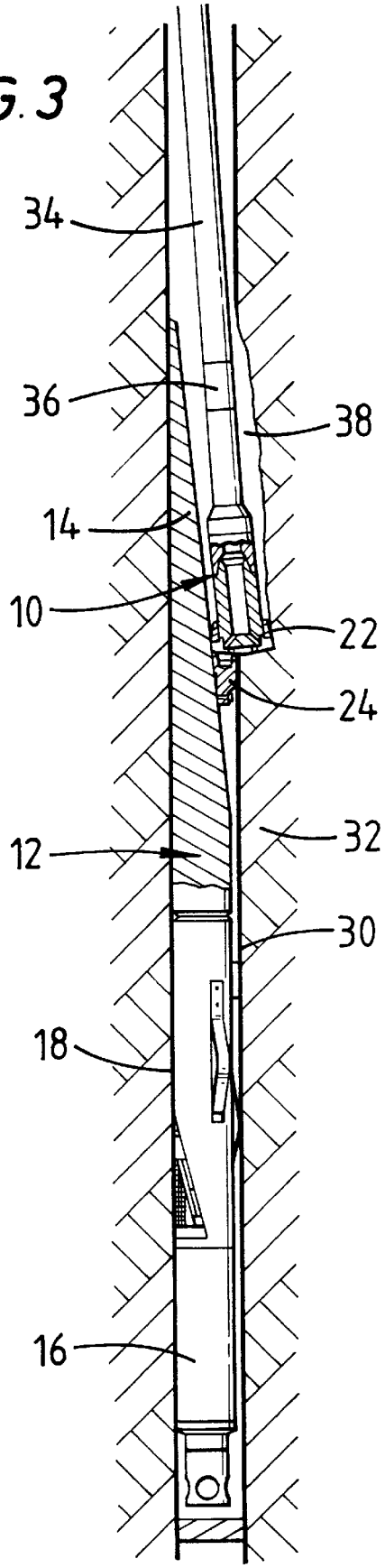
FIG. 3 is a temporally subsequent view to that of FIG. 2.

As shown in FIG. 3 the milling system 20 has progressed downwardly milling out a portion of a window 38 and it has also commenced to mill the nose cone 24. The concave 14 has forced the mill 22 toward the casing to facilitate milling of the window 38. The mill 22 will now proceed to mill further to complete the window 38.

Figure 4:
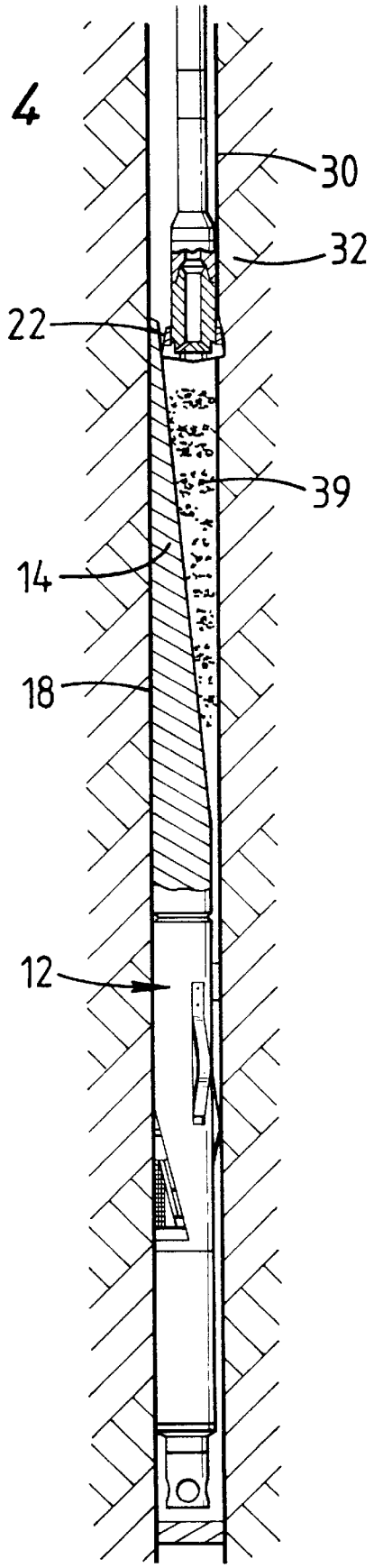
FIG. 4 is an alternative step for the use of the system of FIG. 2.

FIG. 4 presents an alternative way to dispose of the nose cone 24. With an appropriate explosive device, a releasable mechanism releasably securing the nose cone to the concave is exploded, thereby releasing the nose cone and disintegrating it. In one aspect a single explosive device is used. In another aspect one device releases the nose cone from the concave and another device disintegrates the nose cone resulting in relatively small pieces 39 or weakens it to facilitate milling thereof.

The milling system 20 (as is true of any system disclosed herein) can employ any known and suitable cutter, reamer, bit, mill or combination thereof. The setting tool 16 can be any known anchor, setting tool, packer, etc. The mill or mills may have any number of known blades, knives, or cutting elements with any known matrix milling material and/or cutting inserts in any known array or pattern, with or without chipbreakers, over some or all of the blade or element surface. Instead of a mill or mills, a drill bit and drilling system may be used.

Figure 5:
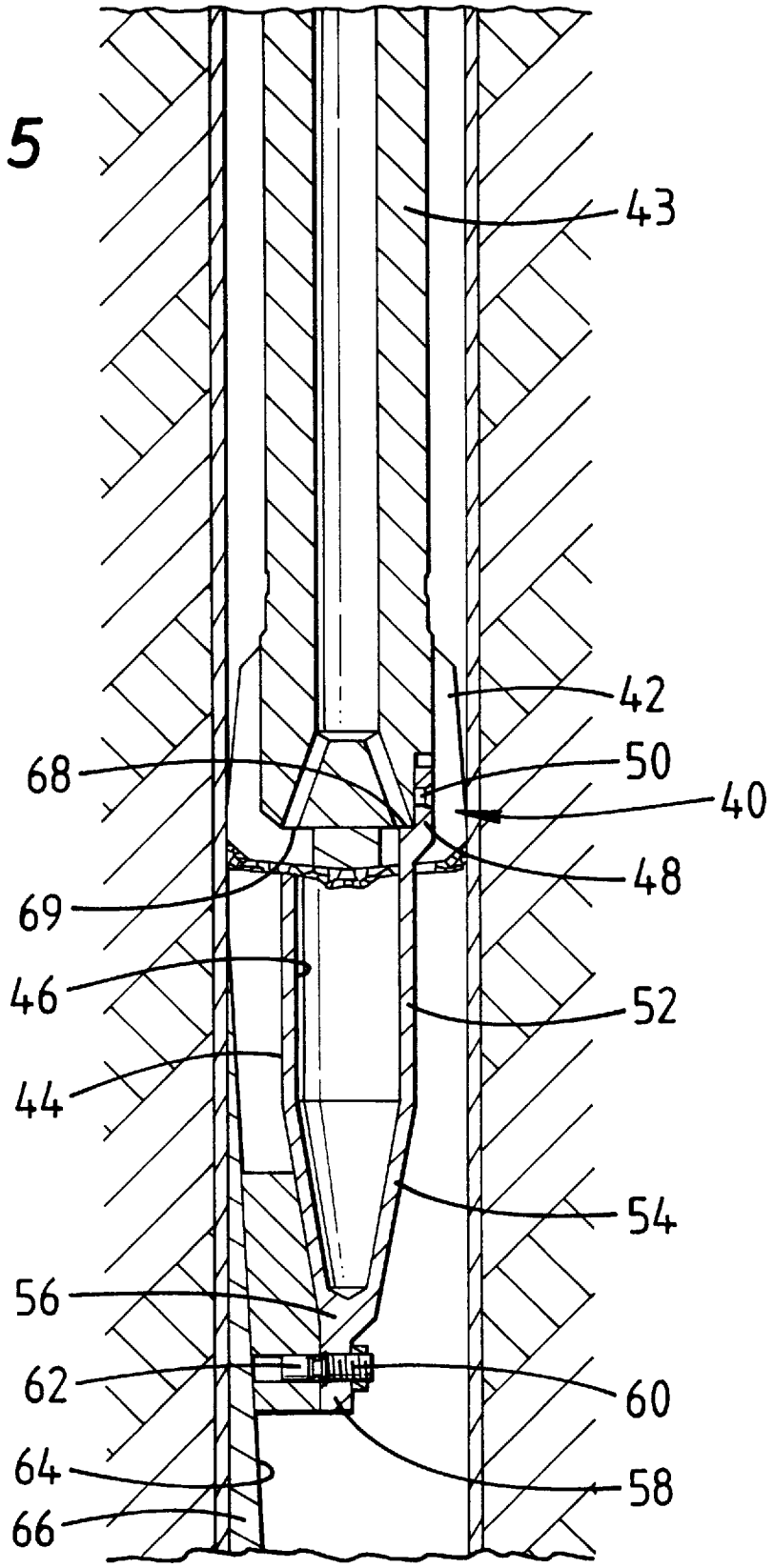
FIG. 5 is a side view of part of the system of FIG. 1.

FIG. 5 shows a milling system 40 (like the milling system 20, FIG. 1 and useful in the methods illustrated in FIGS. 1–4) which has a mill 42 on a string 43 with a hollow nose cone 44. The nose cone 44 has an inner space 46. A top end 48 is secured to the mill 42 by pins 50 (e.g. stainless steel pins straddling tops of the fingers and extending into half-recesses in the fingers and half recesses in the mill body). The nose cone has a body 52 and a lower taper portion 54, the taper portion meeting at an end 56 from which projects a bar 58 through which extends a shear bolt 60 that pins the bar 58 to a lug 62 of a concave 64 of a whipstock 66. The whipstock 66 is in a tubular (e.g. casing) in a string of tubulars in a wellbore (not shown). For stability a shoulder 68 abuts a surface 69 of the mill 42. An explosive charge may be placed on the hollow nose cone and detonated by a firing head in or above the mill to disintegrate the nose cone following its release from the mill.

Figure 6:
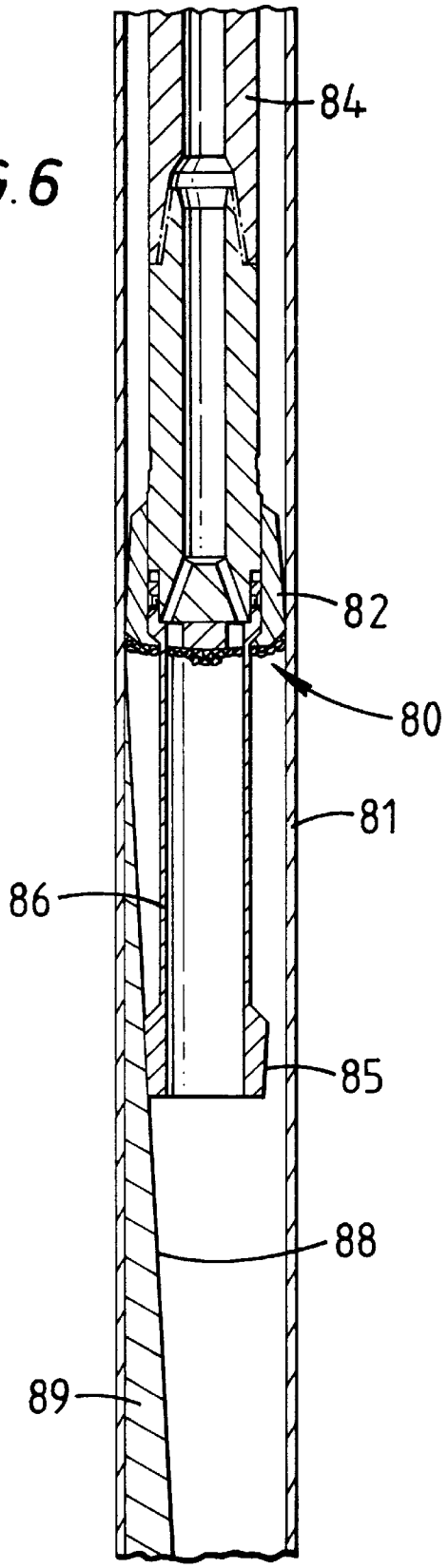
FIG. 6 is a side view in cross-section of a milling system according to the present invention.
Figure 7:
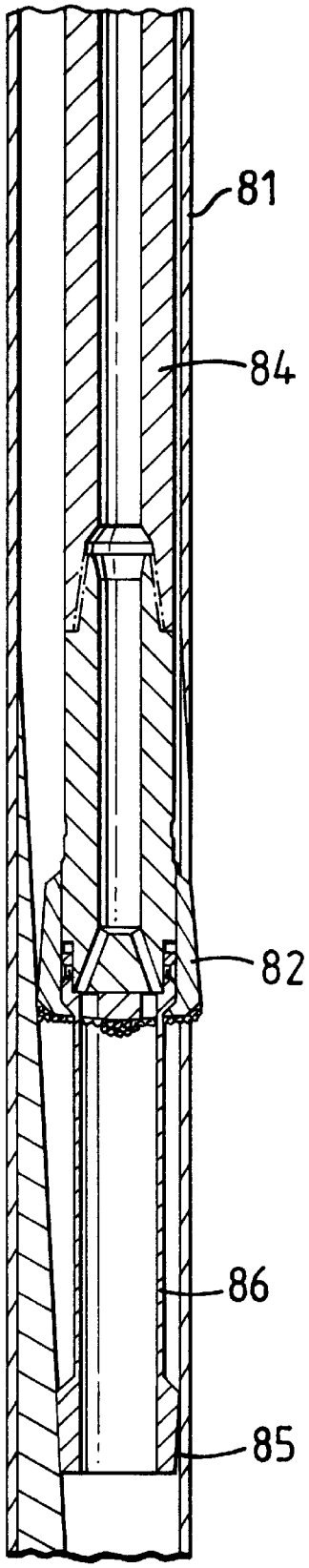
FIG. 7 is another side view in cross-section of the system of FIG. 6.

FIGS. 6 and 7 disclose a milling system 80 with a mill 82 on a string 84 having a pilot member 86 with its top releasably attached to the mill 82 and with its bottom releasably attached to a concave 88 of a whipstock 89. The pilot member 86 can be attached to the concave 88 with a shear pin or shear bolt or by welding or using an adhesive. The pilot member can be separated from the concave by applying weight on shear pin(s), shear bolt(s), or on a welded area, or by using an explosive charge to sever the concave-pilot-member connection.

The pilot member 86 has a taper surface 85 fashioned and configured to move down along the concave 88 thereby inhibiting movement of the mill against the concave and facilitating direction of the mill against casing 81 which is to have a window 87 milled therethrough. As shown, the pilot member 86 is a cylinder with an upper end secured to the mill 82 in a fashion similar to that of the nose cone 44, FIG. 5. Alternatively, the pilot member 86 can have fins like those of the nose cone 44.

When the pilot member reaches the position shown in FIG. 7, it is released from the mill 82, explosively severed from the mill 82, and/or explosively destroyed or explosively weakened so the mill 82 can continue downward milling of the window 87. In one aspect the portion of the window 87 milled as shown in FIG. 7 is between about 10 to about 30 inches; but this distance is adjustable depending on the length of the pilot member 86.

Figure 8A:
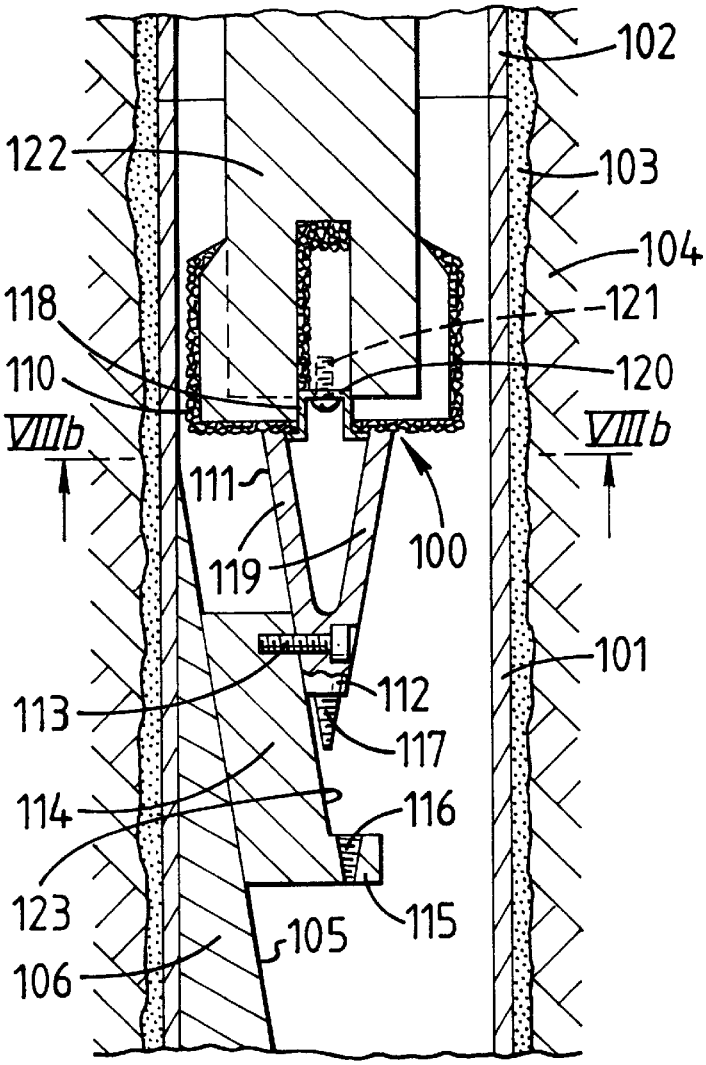
FIGS. 8*a* is a side view in cross-section of a milling system according to the present invention.
Figure 8B:
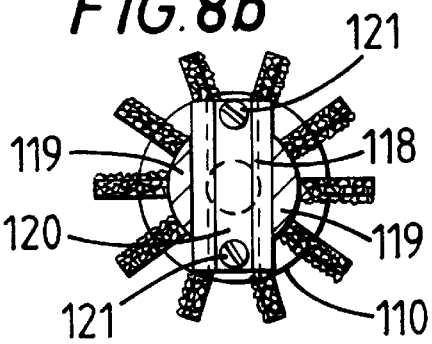
FIG. 8*b* is an end view of the system of FIG. 8*a*.

FIGS. 8*a* and 8*b* show a milling system 100 according to the present invention which is disposable in a tubular 101 (e.g. casing) of a tubular string 102 in a wellbore 103 in a formation 104 extending from the earth's surface to a location beneath it. The milling system 100 has milling apparatus 110 associated with a concave 105 of a whipstock 106. The whipstock may be any known suitable whipstock or diverter, as may be the concave. A nose member 111 has an end 112 shear-pinned with a pin 113 to a lug 114 which is secured to or formed integrally of the concave 105. The lug 114 has a projection 115 with a threaded hole 116 for receiving and threadedly mating with a threaded projection 117 of the nose member 111. A brace 118 extends between two arms 119 of the nose member 111 and an upper piece 120 is secured to the milling apparatus 110 with a bolt 121 which extends into a body 122 of the milling apparatus 110. Upon shearing of the pin 113, the tapered arms 119 move on a corresponding tapered surface 123 of the lug 114 and keep the milling apparatus 110 spaced apart from the concave 105 facilitating engagement of the casing 101 by the cutting portion of the milling apparatus 110. The threaded projection 117 eventually enters and is threaded into the hole 116 at which point the nose member is released from the milling apparatus 110 due to its further rotation and downward movement as it mills the casing 101. The milling apparatus 110 then mills away the lug 114 and the nose member 111.

Figure 9:
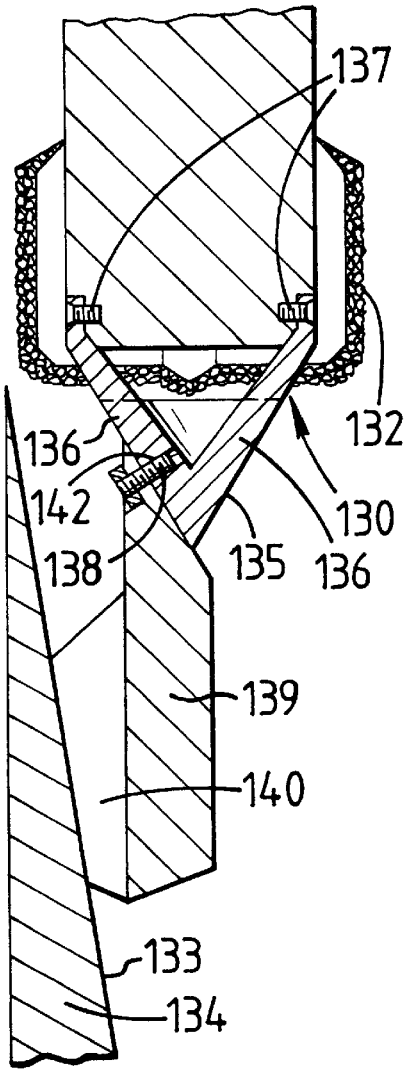
FIG. 9 is a side view in cross-section of a milling system according to the present invention.

FIG. 9 shows a milling system 130 according to the present invention which is disposable in a tubular (e.g. casing) (not shown, like the system of FIG. 8*a*). The milling system 130 has a mill 132 associated with a concave 133 of a whipstock 134. The whipstock may be any known suitable whipstock or diverter, as may be the concave. A nose member 135 has a hole 142 therethrough through which extends a shear bolt 138. The shear bolt 138 releasably pins the nose member 135 to a top portion 139 of a lug 140. The lug 140 is secured to the concave 133. Two braces 136 of the nose member 135 are secured with bolts 137 to the mill 132. In one aspect the nose member is made of mild steel. The mill 132 is freed for milling by shearing the shear bolt 138. Then the tapered brace surface of a brace 136 moves down on the tapered surface of the lug 140, spacing apart the mill 132 from the concave 133 as milling of the tubular commences. In one aspect the nose member 135 is a solid cone releasable by circulating fluid under pressure down through the mill 132 with sufficient force to shear the bolts 137.

FIGS. 10*a* and 10*b* show a milling system 150 with a mill 152 releasably secured to a lug 155 on a concave 153 of a whipstock 154 set in a tubular (not shown, as in FIG. 8*a*). The mill 152 has a body 156 with a channel 157 in which is movably disposed a central member 158 which is urged upwardly by a spring 159. A shear pin 160 initially prevents the central member 158 from moving up in the mill 152. A shear bolt 161 releasably holds the central member 158 to the lug 155 and a shear bolt 162 releasably holds the lug 155 to the concave 153. Upon shearing of the shear bolt 162, the lug 155 is free to move downwardly at an angle within a sleeve 163 secured to the concave 153. As the lug 155 moves down, the mill is rotated about the central member 158 without severing the shear bolt 161 to initiate milling of the tubular in which the system is positioned. Once the lug 155 reaches the limit of its downward travel in the sleeve 163, the shear bolt 161 is sheared to permit further downward movement of the mill 152. At this point the shear pin 160 is sheared permitting the central member 158 to retract back into the mill 152 due to the force of the spring 159. As the central member 158 moves up, spring loaded detents 164 move into recesses 165 to hold the central member 158. A lower end 166 of the central member 158 is dressed with milling material and/or inserts to assist in milling of the opening through the tubular. Alternatively the lug 155 can have a projection into a recess in the concave, the recess holding the projection and the projection moving down in the recess once the shear bolt 162 is sheared. In another aspect projections on the lug 155 ride in or on rails on the concave.

FIG. 11 shows a milling system 170 similar to that of FIGS. 8*a* and 9 with a mill 172 and a concave 173; but a nose 174 is not directly secured to a lug. Instead a hinge 176 is pivotably connected to the concave 173 and pivotably connected to a bar 177 of the nose 174. The hinge 176 will space the mill 172 apart from the concave as the mill 172 begins to mill an opening in a tubular (not shown) in which the system 170 is disposed until the hinge 176 reaches a downward travel limit. At this point the mill 172 will mill away the hinge 176 and continue to mill an opening, window, etc. in the tubular.

Figure 12:
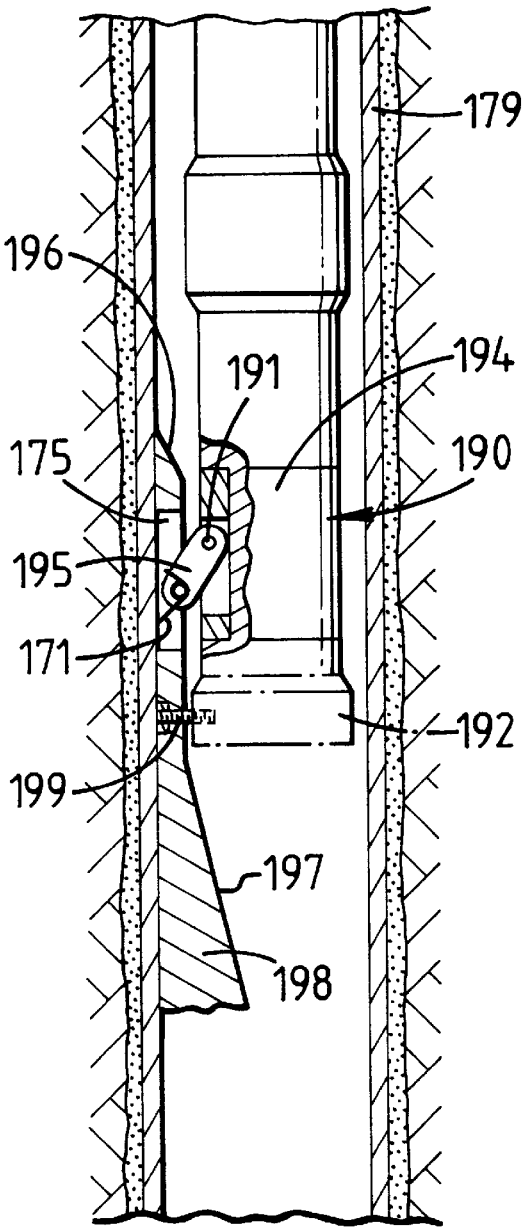

FIG. 12 shows a milling system 190 according to the present invention which has a mill 192 whose body 193 is initially freely movable in a sleeve 194. A hinge 195 is pivotably connected to the sleeve 194 and to an upper extension 196 of a concave 197 of a whipstock 198. Initially a shear pin 199 releasably holds the mill 192 to the concave 197. A shear pin 191 holds the hinge 195 to the sleeve 194. A spring 171 on the hinge 195 urges it back into a recess 175 when the shear pin 191 is sheared. Upon shearing of the shear pin 199, the mill is freed to move out and down to commence milling an opening in a tubular 179 (like the tubular of FIG. 8*a*). The concave 197 directs the mill 192 to the tubular 179. Upon reaching the downward travel limit of the hinge 195, the shear pin 191 is sheared, the hinge 195 moves into the recess 175, and the mill 192 is freed for further milling of the tubular 179. The hinge 195 serves to initially space apart the mill 192 and the concave 197.

Figure 13:
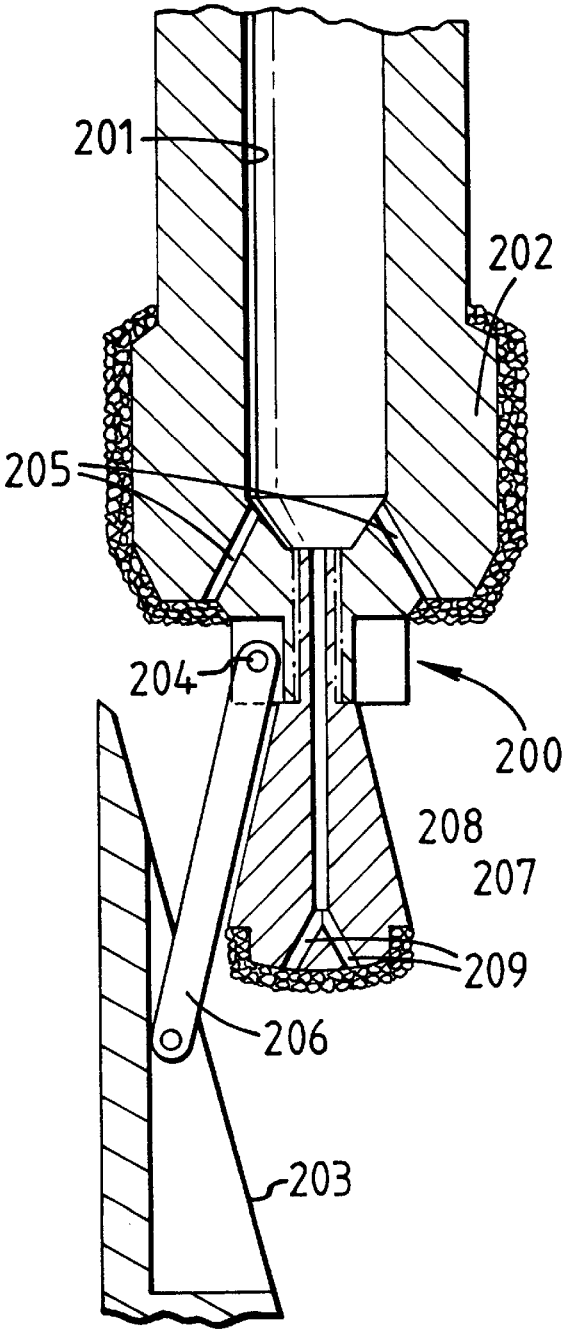

A milling system 200 shown in FIG. 13 is like the system 170 (FIG. 11) but a hinge 206 is pivotably connected directly to a mill 202 at one end and at the other to a concave 203. A central milling member 207 projects downwardly from the mill 202 and has fluid circulation channels 208 and 209 in fluid communication with a central fluid channel 201 of the mill 202. The mill 202 has typical fluid circulation channels 205. Any mill described or shown herein can have well-known fluid circulation channels to facilitate debris and cuttings movement and removal. A shear pin 204 is used to initially releasably hold the hinge 206 to the mill 202.

Figure 14:
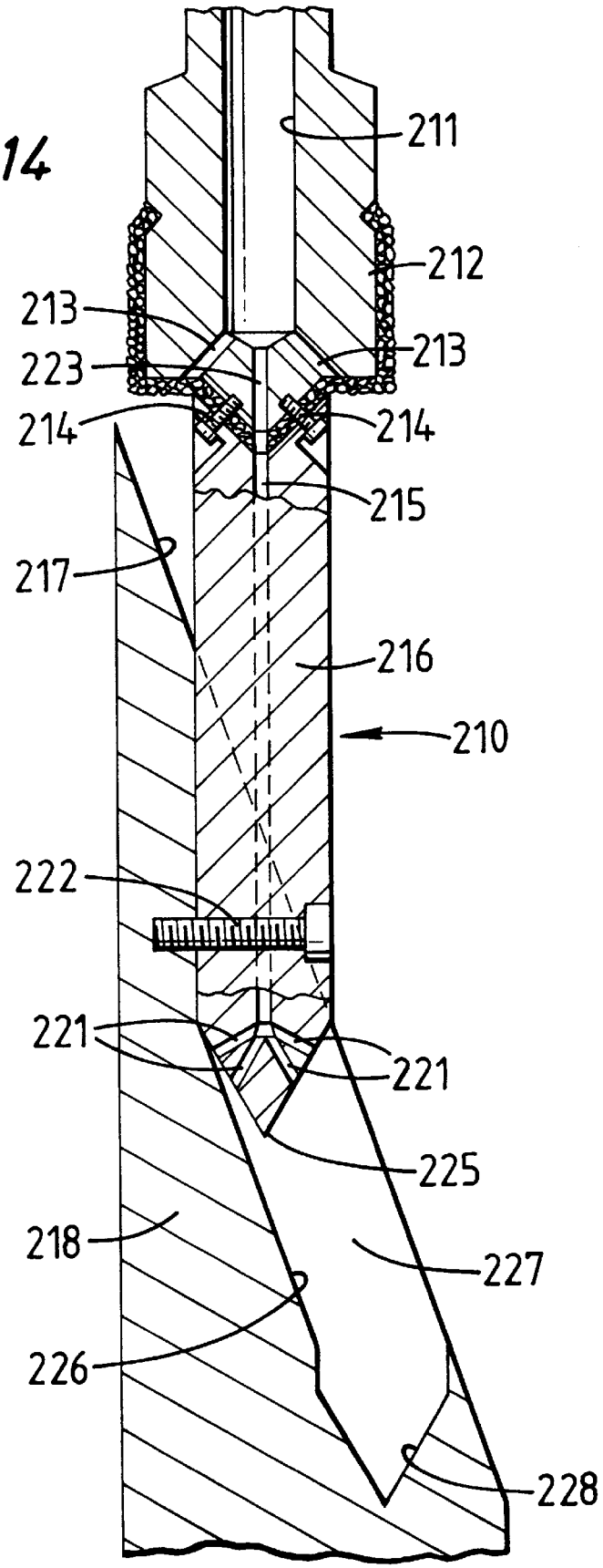

FIG. 14 shows a system 210 with a mill 212 having a central member 216 projecting downwardly and shear-pinned with a pin 222 to a concave 217 of a whipstock 218. This system is for milling a tubular (not shown) like the tubulars of the previously described systems. Circulating fluid flows through a string (not shown) to which the mill 212 is connected into a channel 211 of the mill 212, to wash ports 213 and through a channel 223 to a channel 215 of the central member 216 and then to wash ports 221 of the central member 216. Shear pins 214 releasably hold the central member 216 to the mill 212. A nose end 225 of the central member 216 is sized and configured to move down (upon shearing of the shear pin 222) a tapered surface 226 of a recess 227 in the concave 217 and then to be received in a correspondingly-shaped recess 228 in the concave 217. As the nose end moves, it spaces apart the mill 212 and concave 217 as the mill 212 begins to mill the tubular in which the system 210 is located. When the nose end 225 enters the recess 228, the shear pins 214 shear, freeing the mill 212 for milling the opening in the tubular and for milling the central member 216.

Figure 15:
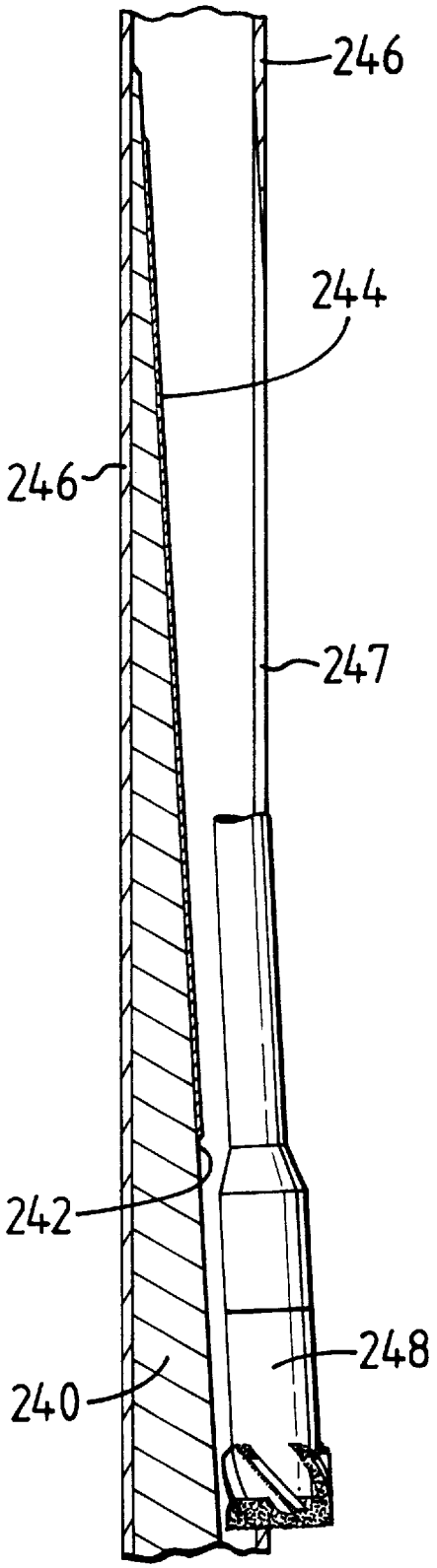
FIG. 15 is a side view in cross-section of a concave of a whipstock according to the present invention.

FIG. 15 shows a whipstock 240 with a concave 242 and an armored portion 244 of the concave 242 armored with armor material. In a particular embodiment in which the whipstock 240 is used in a tubular 246 (in a wellbore such as previously described wellbores) to mill a window 247 with a mill 248 (such as, e.g., mills previously described herein), the armor material is harder than the material of which the tubular 246 is made. Any previously described lug, concave, or part thereof, or nose may be armored with the armored material.

Figure 16:
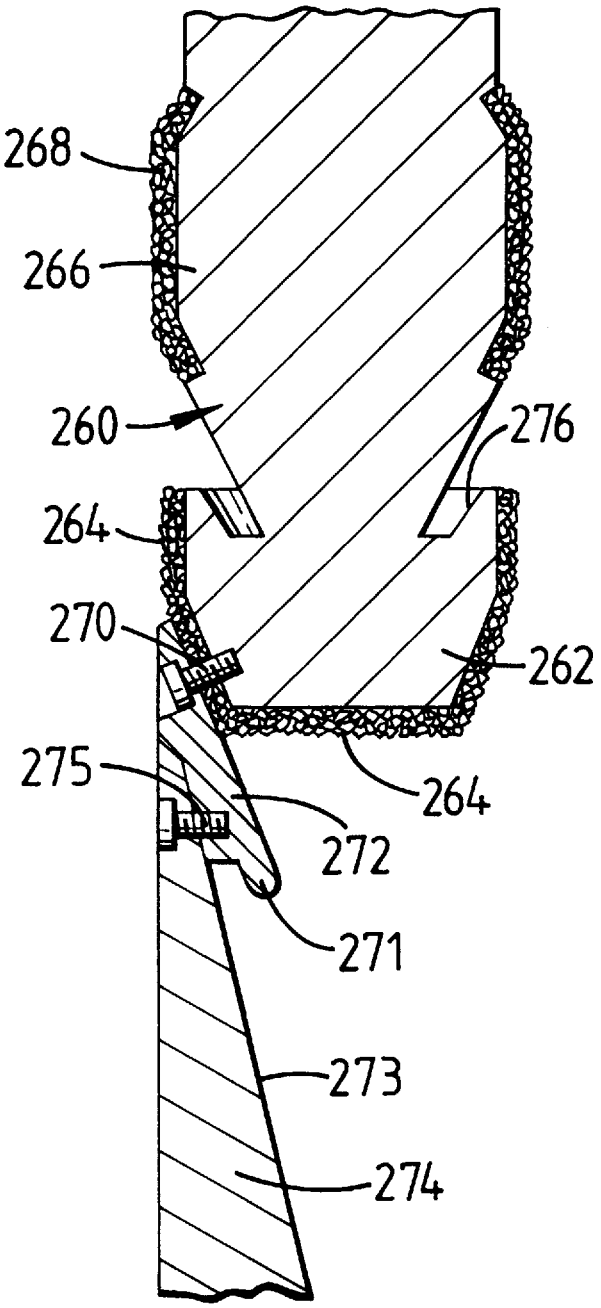
FIG. 16 is a side view in cross-section of a milling system according to the present invention.

FIG. 16 shows a mill 260 according to the present invention with a nose 262 dressed with milling material 264 and an upper portion 266 dressed with milling material 268. A shear pin 270 releasably connects the mill 260 to an armor member 272 which is itself releasably connected to a concave 274 of a whipstock by a shear pin 275. The mill 260 is useful to mill a tubular (as any tubular previously described herein). A recessed portion 276 of the mill 260 is configured, shaped, positioned and disposed to receive a finger 271 of the member 272 when the mill 260 is removed from the wellbore in which it is being used to remove the member 272 upon shearing of the shear pin 275.

Figure 17A:
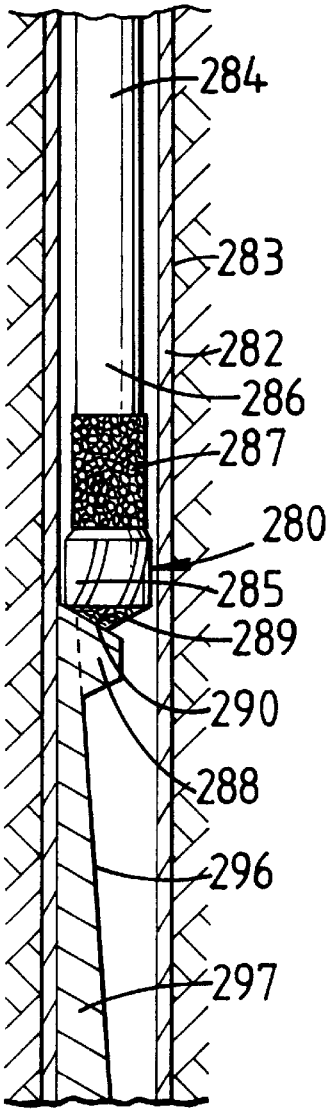
FIG. 17*a* is a side view in cross-section of a milling system according to the present invention.
Figure 17B:
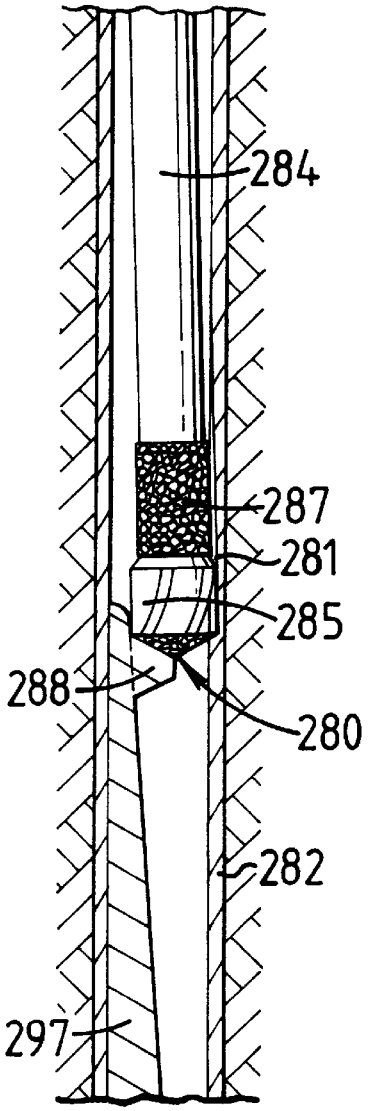
FIG. 17*b* is a temporally subsequent view to that of FIG. 17*a*.
Figure 17C:
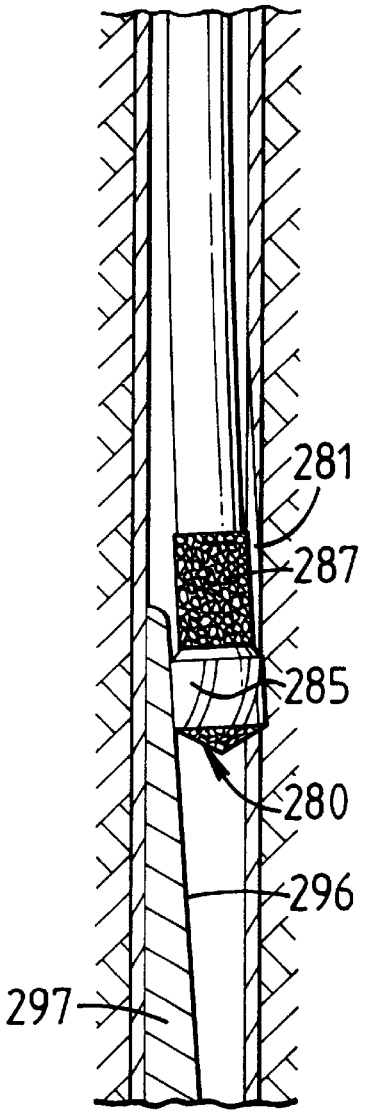
FIG. 17*c* is a temporally subsequent view to that of FIG. 17*b*.

FIGS. 17*a*–17*c* show a milling system 280 according to the present invention for milling a window 281 in a casing 282 in a wellbore 283. The milling system 280 is connected to a tubular string or coiled tubing 284 which extends to the surface and a mill 285 is rotated by a downhole motor (not shown) or by a rotary (not shown). The system 280 includes a tubular body 286 to which the mill 285 is secured and a sleeve 287 disposed around and fixed to the tubular body 286. Initially the mill 285 (see FIG. 17*a*) is releasably attached to a lug 288 of a concave 296 of a whipstock 297 set in the casing 282 (lug made, in one aspect, of wear resistant material), and the bottom of the mill 285 and sides of the mill 285 dressed with matrix milling material and presenting a rough surface to the casing 282. Preferably the sleeve 287 is dressed with milling matrix material and has a rough surface for smoothing edges of the opening made by the mill 285. The nose 289 of the mill 285 has a taper which corresponds to a taper 290 of the lug 288. As shown in FIG. 17*b*, the mill 285 has moved down on the lug 288 and initiated an opening through the casing 282. As shown in FIG. 17*c*, the mill 285 has begun milling the window 281 and has milled off the lug 288. The sleeve 287 may be rotatably mounted around the body 286.

When any system used herein results in a mill milling through the casing and then milling into formation outside the casing, an initial part of a lateral wellbore may be formed by the mill. This part, in certain embodiments, may extend for several feet, e.g. up to about two, ten, fifty, or a hundred feet. Alternatively a mill may be used which will advance a hundred yards or more into the formation.

Referring now to FIGS. 18*a*–18*h* and 19*a* and 19*b*, a tool 310 according to the present invention has a whipstock 320 according to the present invention with a pilot block 324 welded near a top 326 thereof. The whipstock has a concave face 322. The pilot block 324 has bolt holes 328.

The tool 310 has a starting bar 360 which has a body 362 which is secured to the whipstock 320 by bolts 369 through holes 363 extending into holes 328 in the pilot block 324. A groove 364 encircles the body 362. A stop bar 329 (see FIG. 21) extends through a stop pin hole 366.

Figure 18A:
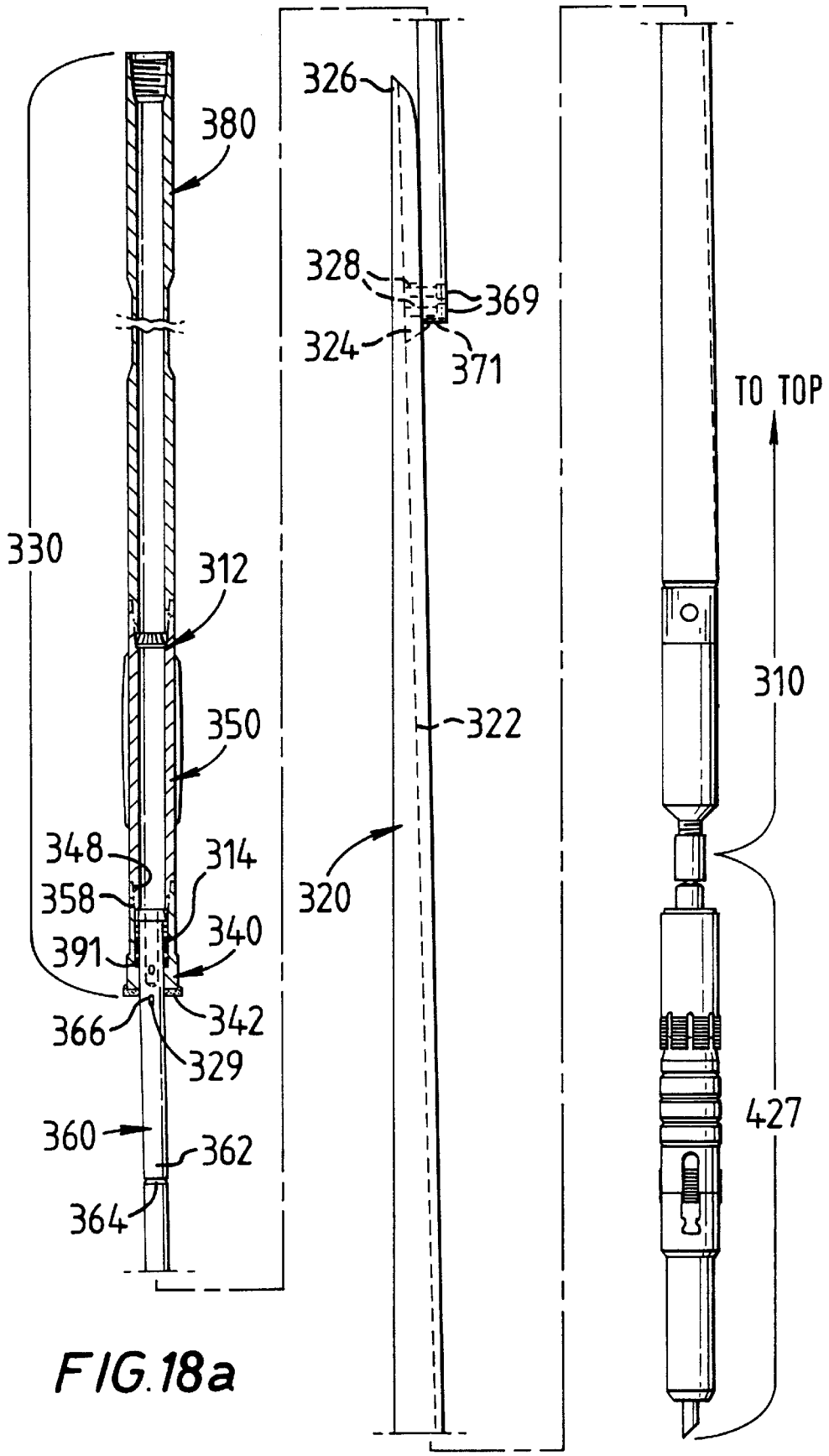
Figure 25:
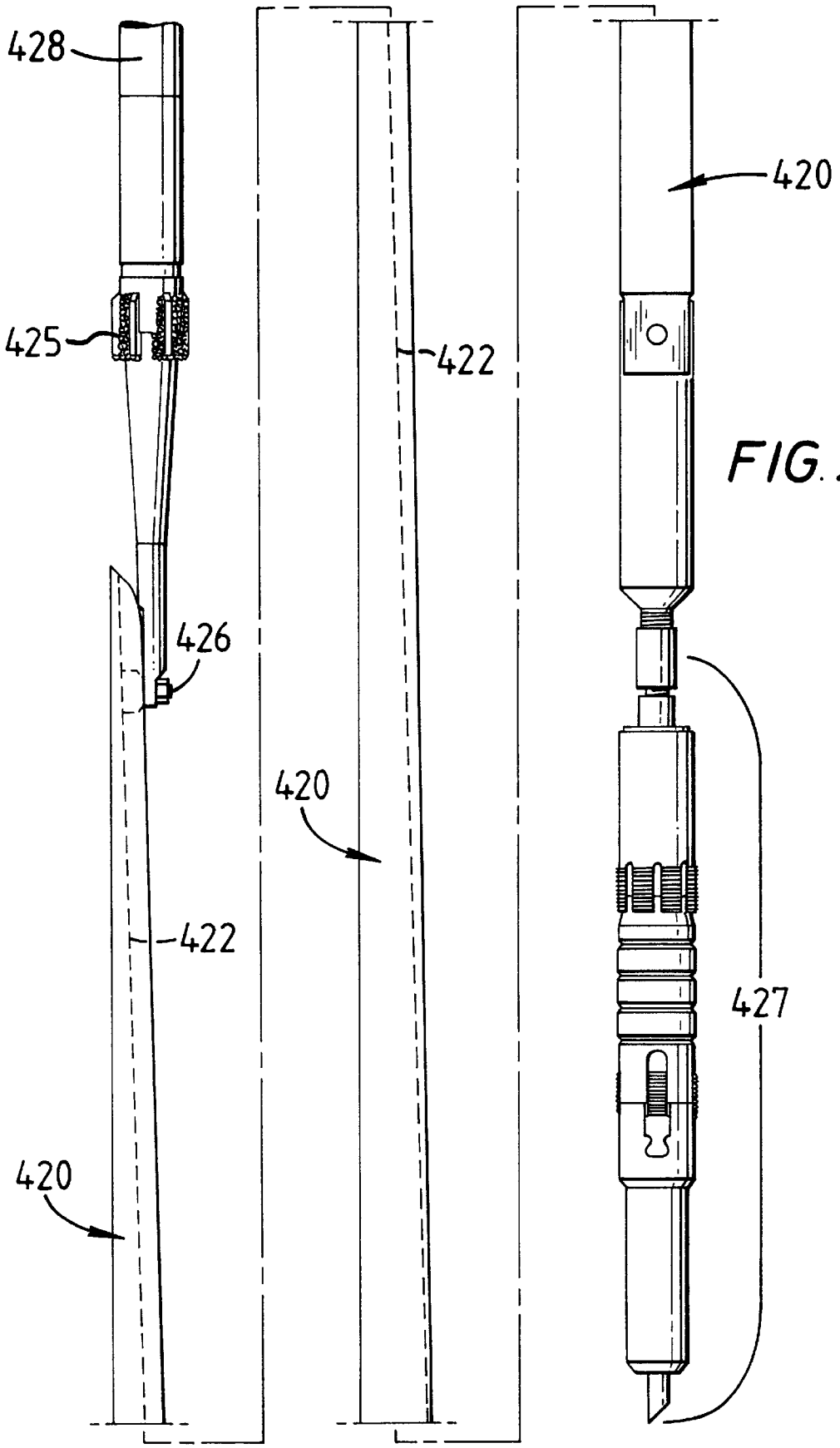
FIG. 25 is a side view of apparatus according to the present invention.

The tool 310 has the milling apparatus 330 which includes at least one and preferably two or more mills so that a milling operation for producing a sidetracking window in casing can be accomplished in a dual or single tool trip into a cased wellbore. As shown in FIGS. 18*a* and 19*a*, the milling apparatus 330 includes a starting mill 340 connected to and below a hollow finishing mill 350. Interior threads 348 of the starting mill 340 engage exterior threads 358 of the finishing mill 350.

The starting mill 340 has a central channel 344 therethrough and a cutting end with carbide cutters 342. A core catcher 314 is disposed within the starting mill 340 and rests on a shoulder 347 to receive and hold debris such as an initial casing sliver, etc. The core catcher 314 is a typical two-piece core catcher.

The finishing mill 350 has a plurality of milling blades 352 and a central channel 354 therethrough. A retainer 312 is disposed within the channel 354 and rests on a shoulder 357 of the mill 350. The retainer 312, as shown in FIG. 18*g*, preferably is a spring with a plurality of fingers 355 which are disposed so that the fingers 355 protrude into the groove 364 of the starting bar 360, preventing the starting bar 360 from moving downwardly from the position shown in FIG. 21.

To accommodate a substantial portion of the starting bar 360 when its length exceeds that of the combined lengths of the mill(s), a pup joint may be used such as the pup joint 380. External threads 386 on the lower end of the pup joint 380 engage upper internal threads 356 of the finishing mill 350. Upper internal threads 388 of the pup joint engage a part of a drill string (not shown) e.g. a crossover sub with a mud motor above it. A central channel 384 extends through the pup joint and is sized and configured to receive a portion of the starting bar 360.

FIGS. 19*a* and 19*b* illustrate steps in the use of a tool 310 according to this invention. As shown in FIG. 19*a*, the milling apparatus 330 has a top portion 365 of the starting bar 360 within the starting mill 340 and the starting bar 360 is secured to the whipstock 320. As shown in FIG. 19*b* the starting mill 340 and apparatus above it have pushed down on the bar 329, breaking it, and permitting the milling apparatus 330 to receive a substantial portion of the starting bar 360. The starting mill 340 has moved to contact the pilot block 324 and mill off the bar 329.

Milling now commences and the starting mill 340 mills through the pilot block 324. As the starting mill moves down the concave face of the concave member 320, the concave member 320 is moved sideways in the casing (to the left in FIGS. 19*a* and 19*b*) and a window is begun in the casings interior wall. As shown in FIG. 21 the fingers 355 have entered the groove 364, preventing the starting bar 360 from falling out of the apparatus or from being pumped out by circulating well fluid. The starting bar 360 has an indented end 371 to facilitate entry of a core into the mill.

To move cutting and debris out of the wellbore a circulation fluid is, preferably, circulated downhole through the drill pipe, outside of and past the starting bar between the starting bar's exterior and the mills' interiors, past the core catcher, past a splined bearing 391, past the starting mill between its exterior and the casing's interior and back up to the surface.

As the milling apparatus mills down against the concave member, the finishing mill 350 smooths the transition from the casing edge to the wellbore to complete the milling operation. Then the milling apparatus is removed from the wellbore with the starting bar 360, casing sliver, debris, and core held within the interior of the mills.

Figure 26A:
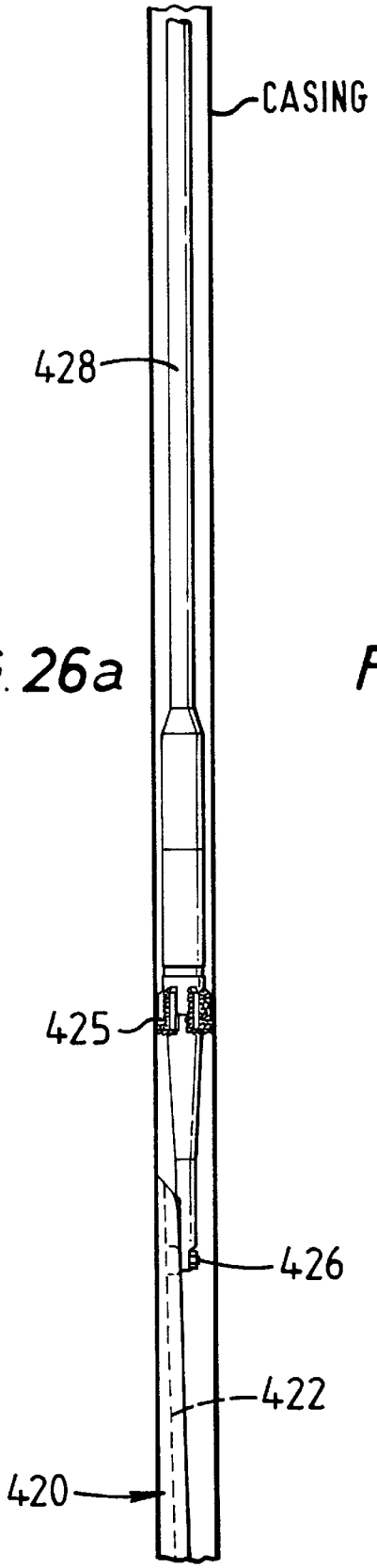
FIG. 26*a* is a side view of apparatus used in a method according to the present invention.
Figure 26B:
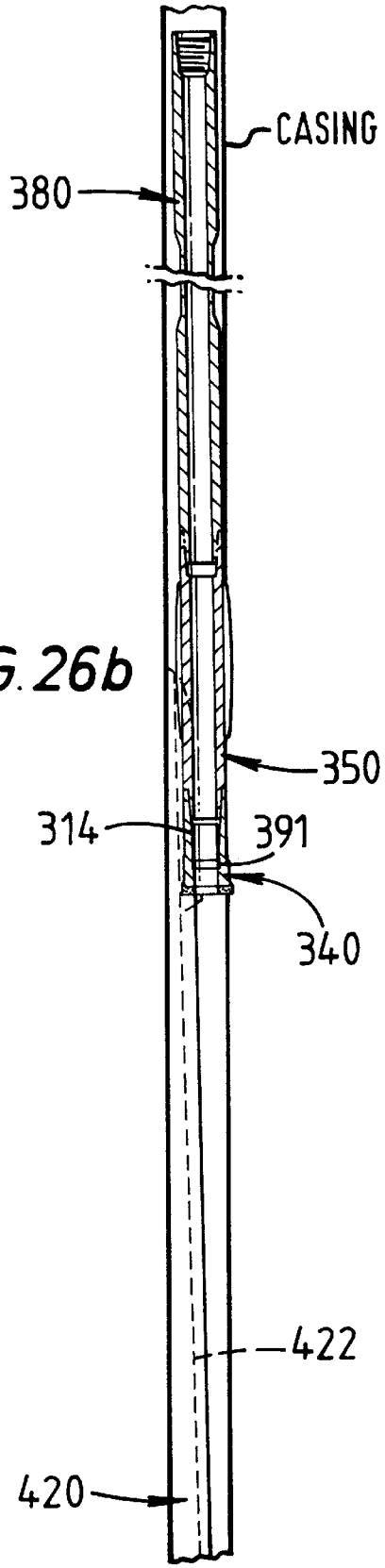
FIG. 26*b* is a side view of apparatus used in a method according to the present invention.

As shown in FIGS. 26*a* and 26*b*, in a two-trip milling operation according to the present invention, a tool 420 including a whipstock concave member 422 and a starting mill 425 secured thereto with a sheer stud 426 is run into a cased wellbore in which some type of anchoring-orientation device, e.g. a keyed packer (not shown), has been installed. Upon emplacement and orientation of the tool 420, the shear stud 426 is sheared by pushing down on the tool and milling is commenced producing an initial window or pocket in the casing. The tool 420 is removed leaving the whipstock concave member 422 in place and then a milling system (like the system shown in FIG. 19*b*) is run into the hole to continue milling at the location of the initial window or pocket. This milling system includes the items above the starting bar 360 in FIG. 19*a,* but not the starting bar 360; and the milling system, as shown in FIG. 26*b,* is used as previously described but without the starting bar. This two-trip operation results in a finished window through the casing.

Filed on even date herewith and co-owned with this application is the U.S. application entitled "Wellbore Window Formation" incorporated fully herein for all purposes and a copy of which is filed herewith as part hereof and as an appendix hereto. Incorporated fully herein for all purposes is pending U.S. application Ser. No. 97/642,118 filed on May 2, 1996 entitled "Wellbore Milling System." All applications and patents referred to herein are incorporated fully herein for all purposes.

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A milling system for milling an opening in a hollow tubular in a wellbore, the milling system comprising milling apparatus, the milling apparatus disposable with respect to a whipstock in the tubular in the wellbore, and a nose member releasably secured to the milling apparatus, the nose member disposed exteriorly of the whipstock and releasably secured to the whipstock with a shearable member, the nose member disposed between the milling apparatus and the whipstock, the nose member and shearable member disposed so that upon release of the nose member from the milling apparatus the nose member is separable entirely apart from and beneath the milling apparatus.

2. The milling system of claim 1 wherein the nose member is made of millable material.

3. The milling system of claim wherein the nose member is movably attached to the milling apparatus.

4. The milling system of claim 1 wherein the nose member is movably attached to the whipstock.

5. The milling system of claim 1 wherein the whipstock has a concave portion with a tapered surface and the nose member has a corresponding tapered surface for movement along the tapered surface of the concave portion.

6. The milling system of claim 1 wherein the nose member is a hollow cylinder.

7. The milling system of claim 1 further comprising the whipstock, and anchor apparatus for anchoring the whipstock in the wellbore.

8. The milling system of claim 7 wherein the whipstock has a lug projecting therefrom and the nose member is movable on the lug.

9. A milling system for milling an opening in a hollow tubular in a wellbore, the milling system comprising milling apparatus, the milling apparatus disposable with respect to a whipstock in the tubular in the wellbore, a whipstock, anchor apparatus for anchoring the whipstock in the wellbore, a nose member releasably secured to the milling apparatus, the nose member disposed exteriorly of the whipstock and releasably secured to the whipstock with a shearable member, the nose member disposed between the milling apparatus and the whipstock, the nose member and shearable member disposed so that upon release of the nose member from the milling apparatus the nose member is separable entirely apart from and beneath the milling apparatus.

the nose member made of millable material and movably attached to the milling apparatus and to the whipstock, the whipstock having a concave portion with a tapered surface and the nose member having a corresponding tapered surface for movement along the tapered surface of the concave portion, and the whipstock having a lug projecting therefrom and the nose member is movable on the lug.

* * * * *